US012396491B2

(12) United States Patent
Harden et al.

(10) Patent No.: US 12,396,491 B2
(45) Date of Patent: Aug. 26, 2025

(54) SMOKING SUBSTITUTE DEVICE/SYSTEM

(71) Applicant: Imperial Tobacco Limited, Bristol (GB)

(72) Inventors: Daniel Harden, San Jose, CA (US); Jonathan Marchbank, Liverpool (GB); Thomas Sudlow, Liverpool (GB); Pete Lomas, Liverpool (GB); Chris Lord, Liverpool (GB); John Mckeon, Liverpool (GB); Britt Jensen, San Jose, CA (US); Brian Leach, San Jose, CA (US)

(73) Assignee: Imperial Tobacco Limited, Bristol (GB)

( * ) Notice: Subject to any disclaimer, the term of this patent is extended or adjusted under 35 U.S.C. 154(b) by 617 days.

(21) Appl. No.: 17/677,466

(22) Filed: Feb. 22, 2022

(65) Prior Publication Data

US 2022/0175050 A1 Jun. 9, 2022

Related U.S. Application Data

(63) Continuation of application No. PCT/EP2020/073978, filed on Aug. 27, 2020.
(Continued)

(30) Foreign Application Priority Data

Sep. 10, 2019 (EP) ..... 19196536
Sep. 10, 2019 (EP) ..... 19196537
(Continued)

(51) Int. Cl.
*A24F 40/95* (2020.01)
*A24F 40/40* (2020.01)
*A24F 40/60* (2020.01)

(52) U.S. Cl.
CPC ..... *A24F 40/95* (2020.01); *A24F 40/40* (2020.01); *A24F 40/60* (2020.01)

(58) Field of Classification Search
CPC ..... A24F 40/95; A24F 40/40; A24F 40/60
See application file for complete search history.

(56) References Cited

U.S. PATENT DOCUMENTS

D829,373 S 9/2018 Huang et al.
2004/0261802 A1 12/2004 Griffin et al.
(Continued)

FOREIGN PATENT DOCUMENTS

CA 3005508 A1 * 6/2017 ..... A24F 47/00
CN 204 157 650 U 2/2015
(Continued)

OTHER PUBLICATIONS

European Search Report (19196536.7-1004), Jun. 26, 2020, 10 pages.
(Continued)

*Primary Examiner* — Christopher M Rodd
*Assistant Examiner* — Ronnie Kirby Jordan
(74) *Attorney, Agent, or Firm* — DUNLAP CODDING, P.C.

(57) ABSTRACT

The present disclosure relates to a smoking substitute device. The smoking substitute device comprises: an elongate main body, the main body having a body length in a longitudinal dimension that is greater than a body width in a transverse dimension. The main body includes a curved portion having a curved longitudinal axis along the longitudinal dimension. The curved longitudinal axis is fixed.

12 Claims, 18 Drawing Sheets

Related U.S. Application Data

(60) Provisional application No. 62/893,696, filed on Aug. 29, 2019, provisional application No. 62/893,686, filed on Aug. 29, 2019, provisional application No. 62/893,704, filed on Aug. 29, 2019, provisional application No. 62/893,702, filed on Aug. 29, 2019, provisional application No. 62/893,692, filed on Aug. 29, 2019, provisional application No. 62/893,698, filed on Aug. 29, 2019, provisional application No. 62/893,694, filed on Aug. 29, 2019.

(30) Foreign Application Priority Data

| | | |
|---|---|---|
| Sep. 10, 2019 | (EP) | 19196540 |
| Sep. 10, 2019 | (EP) | 19196541 |
| Sep. 10, 2019 | (EP) | 19196542 |
| Sep. 10, 2019 | (EP) | 19196543 |
| Sep. 10, 2019 | (EP) | 19196546 |

(56) References Cited

U.S. PATENT DOCUMENTS

| | | | | |
|---|---|---|---|---|
| 2014/0083442 | A1 | 3/2014 | Scatterday | |
| 2015/0101625 | A1 | 4/2015 | Newton et al. | |
| 2015/0257445 | A1 | 9/2015 | Henry, Jr. et al. | |
| 2015/0264978 | A1 | 9/2015 | Arnel et al. | |
| 2017/0071259 | A1 | 3/2017 | Yamada et al. | |
| 2017/0181473 | A1* | 6/2017 | Batista et al. | A24F 47/008 |
| 2017/0208865 | A1 | 7/2017 | Netternstrom et al. | |
| 2017/0258135 | A1 | 9/2017 | Yerkic-Husejnovic et al. | |
| 2018/0132529 | A1 | 5/2018 | Sur et al. | |
| 2019/0099567 | A1* | 4/2019 | Nettenstrom et al. | A61M 15/06 |
| 2019/0124996 | A1 | 5/2019 | Qiu | |
| 2019/0216135 | A1 | 7/2019 | Guo et al. | |

FOREIGN PATENT DOCUMENTS

| | | | |
|---|---|---|---|
| CN | 206 744 578 | U | 12/2017 |
| EP | 2 779 851 | A2 | 9/2014 |
| EP | 3 530 130 | A1 | 8/2019 |
| WO | WO 2017/118553 | A1 | 7/2017 |
| WO | WO 2017/163044 | A1 | 9/2017 |
| WO | WO 2018/084835 | A1 | 5/2018 |
| WO | WO 2018/219949 | A1 | 12/2018 |
| WO | WO 2019/037882 | A1 | 2/2019 |
| WO | WO 2019/084161 | A1 | 5/2019 |
| WO | WO 2019/162152 | A1 | 8/2019 |
| WO | WO 2019/162158 | A1 | 8/2019 |

OTHER PUBLICATIONS

European Search Report (19196537.5-1004), Mar. 27, 2020, 9 pages.

European Search Report (19196540.9-1004), Mar. 19, 2020, 7 pages.

European Search Report (19196541.7-1004), Mar. 26, 2020, 11 pages.

European Search Report (19196542.5-1004), Jun. 29, 2020, 11 pages.

European Search Report (19196543.3-1004), Mar. 26, 2020, 9 pages.

European Search Report (19196546.6-1004), Mar. 25, 2020, 7 pages.

European Patent Office acting as the International Search Authority, International Search Report and Written Opinion regarding PCT/EP2020/073978, Jan. 21, 2021, 20 pages.

* cited by examiner

SMOKING SUBSTITUTE DEVICE/SYSTEM

CROSS-REFERENCE TO RELATED APPLICATIONS/INCORPORATION BY REFERENCE STATEMENT

This application is a non-provisional application claiming benefit to the international application no. PCT/EP2020/073978 filed on Aug. 27, 2020, which claims priority to U.S. provisional application 62/893,686 filed on Aug. 29, 2019, U.S. provisional application 62/893,692 filed on Aug. 29, 2019, U.S. provisional application 62/893,696 filed on Aug. 29, 2019, U.S. provisional application 62/893,698 filed on Aug. 29, 2019, U.S. provisional application 62/893,702 filed on Aug. 29, 2019, U.S. provisional application 62/893,704 filed on Aug. 29, 2019, U.S. provisional application 62/893,694 filed on Aug. 29, 2019, EP 19196536.7 filed on Sep. 10, 2019, EP 19196541.7 filed on Sep. 10, 2019, EP 19196543.3 filed on Sep. 10, 2019, EP 19196546.6 filed on Sep. 10, 2019, EP 19196542.5 filed on Sep. 10, 2019, EP 19196540.9 filed on Sep. 10, 2019, and EP 19196537.5 filed on Sep. 10, 2019. The entire contents of each of the above-referenced applications are hereby incorporated herein by reference in their entirety.

FIELD OF THE DISCLOSURE

The present disclosure relates to a smoking substitute device and smoking substitute system.

BACKGROUND

The smoking of tobacco is generally considered to expose a smoker to potentially harmful substances. It is generally thought that a significant amount of the potentially harmful substances is generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute systems in order to avoid the smoking of tobacco.

Such smoking substitute systems can form part of nicotine replacement therapies aimed at people who wish to stop smoking and overcome a dependence on nicotine.

Smoking substitute systems, which may also be known as electronic nicotine delivery systems, may comprise electronic systems that permit a user to simulate the act of smoking by producing an aerosol, also referred to as a "vapor", which is drawn into the lungs through the mouth (inhaled) and then exhaled. The inhaled aerosol typically bears nicotine and/or flavorings without, or with fewer of, the odor and health risks associated with traditional smoking.

In general, smoking substitute systems are intended to provide a substitute for the rituals of smoking, whilst providing the user with a similar experience and satisfaction to those experienced with traditional smoking and tobacco products.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories. Some smoking substitute systems are designed to resemble a traditional cigarette and are cylindrical in form with a mouthpiece at one end. Other smoking substitute systems do not generally resemble a cigarette (for example, the smoking substitute device may have a generally box-like form).

There are a number of different categories of smoking substitute systems, each utilizing a different smoking substitute approach. A smoking substitute approach corresponds to the manner in which the substitute system operates for a user.

One approach for a smoking substitute system is the so-called "vaping" approach, in which a vaporizable liquid, typically referred to (and referred to herein) as "e-liquid", is heated by a heater to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute system includes a mouthpiece, a power source (typically a battery), a tank or liquid reservoir for containing e-liquid, as well as a heater. In use, electrical energy is supplied from the power source to the heater, which heats the e-liquid to produce an aerosol (or "vapor") which is inhaled by a user through the mouthpiece.

Vaping smoking substitute systems can be configured in a variety of ways. For example, there are "closed system" vaping smoking substitute systems which typically have a heater and a sealed tank which is pre-filled with e-liquid and is not intended to be refilled by an end user. One subset of closed system vaping smoking substitute systems includes a device which includes the power source, wherein the device is configured to be physically and electrically coupled to a consumable including the tank and the heater. In this way, when the tank of a consumable has been emptied, the device can be reused by connecting it to a new consumable. Another subset of closed system vaping smoking substitute systems are completely disposable, and intended for one-use only.

There are also "open system" vaping smoking substitute systems which typically have a tank that is configured to be refilled by a user, so the system can be used multiple times.

An example vaping smoking substitute system is the myblu™ e-cigarette. The myblu™ e cigarette is a closed system which includes a device and a consumable. The device and consumable are physically and electrically coupled together by pushing the consumable into the device. The device includes a rechargeable battery. The consumable includes a mouthpiece, a sealed tank which contains e-liquid, as well as a vaporizer, which for this system is a heating filament coiled around a portion of a wick which is partially immersed in the e-liquid. The system is activated when a microprocessor on board the device detects a user inhaling through the mouthpiece. When the system is activated, electrical energy is supplied from the power source to the vaporizer, which heats e-liquid from the tank to produce a vapor which is inhaled by a user through the mouthpiece.

Another example vaping smoking substitute system is the blu PRO™ e-cigarette. The blu PRO™ cigarette is an open system which includes a device, a (refillable) tank, and a mouthpiece. The device and tank are physically and electrically coupled together by screwing one to the other. The mouthpiece and refillable tank are physically coupled together by screwing one into the other, and detaching the mouthpiece from the refillable tank allows the tank to be refilled with e-liquid. The system is activated by a button on the device. When the system is activated, electrical energy is supplied from the power source to a vaporizer, which heats e-liquid from the tank to produce a vapor which is inhaled by a user through the mouthpiece.

In some systems, the tank may be connected to the device by receipt in a cavity of the device. Whilst this may protect the tank and the contents of the tank (e.g., from light) it can make it difficult for a user to determine the quantity of e-liquid remaining in the tank. Thus, there is a need to provide an improved smoking substitute system.

An alternative to the "vaping" approach is the so-called Heated Tobacco ("HT") approach in which tobacco (rather than an e-liquid) is heated or warmed to release vapor. HT is also known as "heat not burn" ("HNB"). The tobacco may be leaf tobacco or reconstituted tobacco. In the HT approach the intention is that the tobacco is heated but not burned, i.e., the tobacco does not undergo combustion.

The heating, as opposed to burning, of the tobacco material is believed to cause fewer, or smaller quantities, of the more harmful compounds ordinarily produced during smoking. Consequently, the HT approach may reduce the odor and/or health risks that can arise through the burning, combustion and pyrolytic degradation of tobacco.

A typical HT smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes components in the tobacco material to be released as vapor. A vapor may also be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the consumable (entrained in the airflow) from the location of vaporization to an outlet of the consumable (e.g., a mouthpiece), the vapor cools and condenses to form an aerosol for inhalation by the user. The aerosol may contain nicotine and/or flavor compounds.

SUMMARY

According to a first aspect, there is provided a smoking substitute device, comprising: an elongate main body, the main body having a body length in a longitudinal dimension that is greater than a body width in a transverse dimension; wherein the main body includes a curved portion along the longitudinal dimension.

In preferred embodiments, the curved portion includes a curved longitudinal axis (e.g., a curved longitudinal axis extending through the centroid of the main body) extending in the longitudinal dimension. In these embodiments, the curved longitudinal axis may be a fixed axis.

The term "fixed axis" is intended to refer to an axis that has only a single, fixed configuration as opposed to an axis that can be flexed between two different configurations. Accordingly, in these embodiments, the curved portion of the elongate main body has only a single configuration and cannot be moved between multiple configurations.

Optionally, the curved portion is located between a first longitudinal end of the main body and a second, opposite, longitudinal end of the main body.

Optionally, the curved portion extends along substantially the total longitudinal length of the main body.

Optionally, a radius of curvature of the curved portion (i.e., of the curved longitudinal axis) is between 3000 millimeters and 100 millimeters, optionally wherein the radius of curvature of the curve is between 1000 and 300 millimeters.

Optionally, the main body includes an upper housing surface and an opposing lower housing surface, wherein the upper housing surface has an upper radius of curvature in the longitudinal dimension that is different from a lower radius of curvature in the longitudinal dimension of the lower housing surface.

Optionally, the lower radius of curvature is larger than the upper radius of curvature.

Optionally, the upper surface includes a user feedback means.

Optionally, the lower surface includes a concave portion.

Optionally, a total longitudinal length across the upper surface is greater than a total longitudinal length across the lower surface.

Optionally, in a taper region of the main body the upper surface tapers towards the lower surface, the lower surface tapers towards the upper surface, or the lower and upper surfaces taper towards one another.

Optionally, the taper region is along a transverse edge of the main body.

Optionally, the taper region is at a longitudinal end of the main body.

According to a second aspect, there is provided a smoking substitute device, comprising: an elongate main body, the main body having a body length in a longitudinal dimension that is greater than a body width in a transverse dimension; wherein the main body includes an upper surface and an oppositely directed lower surface, the upper and lower surfaces meeting along a pair of oppositely directed transverse edges, wherein an upper surface radius of curvature of the upper surface in the transverse dimension is greater than half a main body depth, wherein the main body depth is a maximum distance between the upper surface and the lower surface; wherein a lower surface radius of curvature in the transverse dimension of the lower surface is greater than half the main body depth.

Optionally, an edge radius of curvature of the transverse edges is less than 5 millimeters, preferably less than 3 millimeters and preferably less than 1 millimeter.

Optionally, the maximum depth of the main body is between 5 and 30 millimeters, preferably between 10 and 20 millimeters.

Optionally, the main body of the device is curved in the longitudinal dimension as described above for the first aspect.

For example, the upper surface radius of curvature may be different from the lower surface radius of curvature, or the upper surface radius of curvature may be substantially equal to the lower surface radius of curvature.

Optionally, the device includes a device charging means located on at least one of the transverse edges.

Optionally, the device includes a device charging means located on the lower surface.

Optionally, the device includes a user feedback means located along at least a portion of one of the transverse edges.

Optionally, the main body has a substantially constant transverse cross sectional shape along the longitudinal dimension.

Optionally, the main body includes an upper housing connected to a lower housing, wherein the upper housing includes the upper surface and the lower housing including the lower surface.

Optionally, the upper housing is connected to the lower housing along the transverse edges.

According to a third aspect, there is provided a smoking substitute device including:

a processor/controller;

a main body, including an illumination region; and a source of light contained within the main body, the illumination region being configured such that light provided by the source of light passes through the illumination region of the main body;

wherein the processor/controller is configured to:

(i) identify an operation of the smoking substitute device; and (ii) control the source of light contained within the main body, to illuminate an area of the illumination region based on the operation of the smoking substitute device identified.

Such a smoking substitute device can more easily indicate identified operations to the user.

The processor/controller may be configured to identify a resource status query operation of the smoking substitute device. The resource query operation may be a battery status query operation and/or a consumable status query operation.

Accordingly, the processor/controller may be configured to control the source of light to illuminate an area of the illumination region proportional to the level of resource remaining e.g., the level of battery charge remaining and/or the level of consumable (e.g., e-liquid) remaining.

Thus, in some preferred embodiments, the processor is configured to:

(i) identify a battery status query operation of the device; and (ii) control the source of light contained within the main body, to illuminate an area of the illumination region proportional to a level of charge stored in a battery.

In some preferred embodiments, the processor is configured to:

(i) identify a consumable status query operation of the device; and (ii) control the source of light contained within the main body, to illuminate an area of the illumination region proportional to a level of consumable remaining (e.g., a level of e-liquid remaining).

The illumination region may be a surface area of the main body. The source of light may be one of a plurality of sources of light, and the processor may be configured to control the plurality of sources of light contained within the main body, to illuminate an area of the illumination region based on the operation of the smoking substitute device identified.

An intensity of the source of light may be controlled so as to vary the area of illumination. There may be plural sources of light contained within the main body, and a number of sources of light emitting light may be controlled so as to vary the area of illumination.

The source(s) of light may be an array of light emitting diodes.

As discussed above, the processor/controller may be configured to identify a battery and/or consumable status query operation of the smoking substitute device, and to illuminate an area of the illumination region proportional to a level of charge stored in the battery and/or level of consumable (e.g., level of e-liquid) remaining.

The processor/controller may be configured to identify a battery charging operation of the smoking substitute device, and to illuminate an area of the illumination region proportional to a current level of charge stored in the battery, and to change the area of the illumination region as the battery charges.

The processor/controller may be configured to identify an inhalation operation of the smoking substitute device, and to increase an area of the illumination region which is illuminated in proportion to a length of the inhalation operation.

The processor/controller may be configured to identify that a predetermined number of inhalation operations have occurred within a predetermined time period, and to decrease an area of the illumination region which is illuminated. For example, the processor/controller may be configured to register the beginning of a usage session of the smoking substitute device, to illuminate a first area of the illumination region at the beginning of the usage session, and to decrease the illuminated area as the number of inhalations increases.

The source(s) of light may include a liquid crystal display.

The illumination region of the main body may be made from a diffusing material, such that light passing through the illumination region from source(s) of light is diffused.

The main body may be a one-piece shell. The one-piece shell may be attached or attachable at one end to a mouthpiece or consumable.

The main body may have a mandorla-shaped cross-section, or an eye-shaped cross-section. It may be as described for the first or second aspect. Advantageously, the illumination region may be located on the front portion and supporting components (wires etc.) may be provided in the void, thereby utilizing the internal volume of the main body in an efficient manner.

The illumination region may be formed of polycarbonate. The illumination region may be formed of acrylic.

The illumination region may extend along at least half of a length of the main body. The illumination region may be contained on one side of the main body, the main body have plural sides.

The main body may include a shell having a first area with a first thickness and a second area with a second thickness, the first area including the illumination region and the first thickness being thinner than the second thickness.

The illumination region may include a plurality of discrete sub-illumination regions. Each sub-illumination may be separated from an adjacent sub-illumination region by an optically opaque divider.

The smoking substitute device may include a mouthpiece, and the illumination region may be located towards an end of the smoking substitute device opposite to the mouthpiece.

The smoking substitute device may include an adaptor/recess for receiving a consumable, and the illumination region may be located towards an end of the smoking substitute device opposite to the adaptor/recess.

In a fourth aspect of the present disclosure, there is provided a smoking substitute device including: a processor/controller; a main body, including an illumination region; and a source of light, contained within the main body, the illumination region being configured such that light provided by the source of light passes through the illumination region of the main body. The illumination region is preferably made of a diffusing material, such that the light passing through the illumination region from the source of light is diffused.

The smoking substitute device of the fourth aspect may have any one, or any combination insofar as they are compatible, of the optional features of any of the first to third aspect.

According to a fifth aspect, there is provided a smoking substitute device/system comprising a movement detection unit for detecting a movement of the device/system, and a haptic feedback generation unit for generating a haptic feedback, and a haptic feedback controller unit configured to control the haptic feedback generation unit to generate the haptic feedback in response to the detection of movement of the device.

Smoking substitute devices/systems are typically configured to be discrete and unobtrusive while being carried in a pocket. Accordingly, it would be advantageous for a user to be able to determine whether or not they have the device/system in their possession. The haptic feedback generation unit can allow a user to cause the system to generate a response to a movement of the device, which can allow functionality including non-visual indication of, for example, device presence, device status, device identity.

Optionally, the haptic feedback may include a sequence of activations (e.g., a sequence of vibrations) of the haptic feedback generation unit. In other words, in preferred embodiments, the haptic feedback controller unit is configured to control the haptic feedback generation unit to generate a haptic feedback including a sequence of activations/vibrations.

Conveniently, the sequence of activations may be selectable from a plurality of activation sequences, and the plurality of activation sequences may be stored in a memory of the haptic feedback controller.

This allows, for example, different responses to be assigned to different movement inputs, or allows user control over their preferred haptic feedback.

Advantageously, the movement detection unit may comprise an accelerometer.

Optionally, the haptic feedback controller unit may be configured to switch between an ON mode wherein the haptic feedback unit is enabled and an OFF mode wherein the haptic feedback unit is disabled.

This allows a user to select whether or not they need a haptic feedback function.

Conveniently, the haptic feedback controller unit and the movement detection unit may be configured to measure a movement of the device/system.

Advantageously, one or more predetermined movements of the device/system may be stored in a memory of the haptic feedback controller unit and the movement detection unit may be configured to identify a movement of the device/system corresponding to the one or more predetermined movements.

The device/system can therefore distinguish between different predetermined movements, and generate a corresponding haptic feedback response to the identified movement.

Optionally, the device/system may be configured to identify a first number of movements and to generate haptic feedback comprising a second number of activations of the haptic feedback generation unit.

Conveniently, the first number and the second number may be equal.

Advantageously, the first number and/or the second number may be equal to or greater than 2.

Optionally, the haptic feedback generation unit may comprise a vibration generator, the vibration generator comprising an electric motor and a weight eccentrically mounted on a shaft of the electric motor.

Embodiments of the fifth aspect may have any one, or any combination insofar as they are compatible, of the optional features of the first to fourth aspects.

According to a sixth aspect of the disclosure, there is provided a method of operating a smoking substitute device/system according to the fifth aspect, the method comprising the steps of detecting a movement of the device/system; and generating a haptic feedback in response to the detection of the movement of the device/system.

According to a seventh aspect, there is provided a smoking substitute device comprising:

a source of power, for providing power to a heater;

a first charging connection, for charging the source of power, located at one end of the smoking substitute device; and a second charging connection, for charging the source of power, located on one or more lateral sides of the smoking substitute device.

Such a smoking substitute device is more easily charged, for example by coupling with a dock or carrying case.

The first charging connection may be a USB connector.

The second charging connection may comprise a first electrical contact and a second electrical contact. The first electrical contact and the second electrical contact may be resiliently biased in a direction away from the smoking substitute device.

The first electrical contact may be located on a first lateral side of the smoking substitute device, and the second electrical contact may be located on a second lateral side of the smoking substitute device. The second lateral side may be opposite to the first lateral side.

The first electrical contact and the second electrical contact may be on the same lateral side of the smoking substitute device. The first electrical contact and the second electrical contact may be located in a row extending along a length of the smoking substitute device away from the first charging connection. The first electrical contact and the second electrical contact may be located in a row extending along a width of the smoking substitute device.

The second charging connection may be nearer the end of the smoking substitute device containing the first charging connection than an opposite end of the smoking substitute device.

The source of power may be a battery. The source of power may be a capacitor.

The smoking substitute device may include the heater. The heater may be used in a vaporizer to vaporize an aerosol precursor.

A main body of the smoking substitute device may have a mandorla-shaped cross-section. The mandorla-shaped cross-section may also be referred to as an eye-shaped cross-section. The main body may be as described for any of the first to fourth aspects. Advantageously, electrical components supporting the secondary charging connection (e.g., wires) can be located within a thinner section of the main body, which increases the packing efficiency of the device.

Embodiments of the seventh aspect may have any one, or any combination insofar as they are compatible, of the optional features of the first to sixth aspects.

According to an eighth aspect there is provided a smoking substitute device comprising a housing defining a cavity for releasable engagement of a tank therein, and an aperture formed in a wall of the housing defining the cavity for viewing the level of an aerosol precursor stored in the tank when engaged in the cavity.

The provision of an aperture in the wall of the housing allows a user to view the level of aerosol precursor, so as to allow the user to predict when replenishment of the aerosol precursor may be required.

The term "aperture formed in a wall" is used to describe a hole rather than a slot or recess formed in an edge of the housing. That is, the aperture has a continuous boundary that fully surrounds (i.e., encloses) the aperture.

The aperture may be elongate so as to define an elongate axis. Thus, the aperture may have a length (parallel to the elongate axis) that is greater than its width (transverse to the elongate axis). The aperture may have a width of between 1 mm and 5 mm. The aperture may have a width of between 2 mm and 4 mm. The aperture may have a length of between 5 mm and 20 mm. The aperture may have a length of between 12 mm and 18 mm. The aperture may have a length of about 15 mm.

The housing may be elongate and may extend along a longitudinal axis. In some embodiments the housing may be curved along its elongate axis. As may be appreciated, in such embodiments the longitudinal axis of the housing may thus be curved. The housing may be as described for any of the first to third aspects.

When the aperture is elongate, the elongate axis of the aperture may be substantially parallel to the longitudinal axis of the housing. In other embodiments the elongate axis of the aperture may be transverse to the longitudinal axis. Alternatively, the elongate axis of the aperture may be arranged obliquely with respect to the longitudinal axis.

The wall of the housing (in which the aperture is formed) may comprise an edge at least partly defining an opening to the cavity (through which the consumable is received). The aperture is spaced from the edge of the wall. The aperture may be proximate to (but spaced from) the edge of the wall. The aperture may be spaced from (e.g., in the longitudinal direction) the edge by less than 5 mm. The aperture may be spaced from the edge by less than 3 mm.

The aperture may have an obround shape. The aperture may have a rectangular shape. The aperture may alternatively be circular.

The device may comprise a window extending across the aperture. The window may seal the aperture.

The aperture may be a first aperture and the housing may comprise a second aperture formed therein. The second aperture may be as described above with respect to the first aperture. Thus, for example, the second aperture may be arranged to allow viewing of the level of an aerosol precursor stored in the tank (when engaged in the cavity).

The second aperture may be formed in an opposite side of the housing to (i.e., across the cavity from) the first aperture.

The housing may comprise front and rear longitudinally extending walls that are spaced by opposing longitudinally extending side walls. The distance between the side walls may define a width of the housing and the distance between the front and rear walls may define a depth of the housing. The width of the housing may be greater than the depth of the housing. The first aperture may be formed in the front wall of the housing and the second aperture may be formed in the rear wall of the housing. Alternatively, the first aperture may be formed in the front or rear wall of the housing, and the second aperture may be formed in a side wall of the housing.

The first and second apertures may both be elongate. In such embodiments, the elongate axis of the first aperture may be orthogonal to the elongate axis of the second aperture. Thus, for example, the first aperture may be oriented so as to parallel to the longitudinal axis of the housing, and the second aperture may be oriented so as to be transverse to the longitudinal axis of the housing. In this way, the first aperture may be configured for assessing a level or aerosol precursor in the tank (when received in the cavity) when the device has a first orientation, and the second aperture may be configured for assessing the precursor level in a second orientation that is orthogonal to the first orientation. For example, the first orientation may be a vertical orientation (e.g., when the device is held by a user) and the second orientation may be a horizontal orientation (e.g., when the device is resting on a surface).

Accordingly, in a preferred embodiment of the eighth aspect, there is provided a smoking substitute device comprising a housing (101) defining a cavity for releasable engagement of a tank (106) therein, and a first aperture (114*a*) formed in a wall of the housing defining the cavity for viewing the level of an aerosol precursor stored in the tank (106) when engaged in the cavity; wherein the housing (101) comprises a second aperture (114*b*) formed therein, the second aperture arranged for viewing the level of the aerosol precursor stored in the tank (106) when engaged in the cavity; wherein the first (114*a*) and second (114*b*) apertures are elongate, each having a respective elongate axis; characterized in that the elongate axis of the first aperture (114*a*) is orthogonal to the elongate axis of the second aperture (114*b*).

In some embodiments, he housing may be configured for snap engagement with the tank (i.e., for retaining the tank in the cavity). For example, the housing may be configured to deform, or may comprise a deformable portion, to provide snap engagement with the tank. The housing (e.g., the deformable portion of the housing) may be deformable so as to alter the shape and/or size of the opening to the cavity.

Alternatively, the device and the tank may be physically coupled together by screwing one onto the other, or through a bayonet fitting.

The tank may form part of a smoking substitute consumable. In other embodiments, the tank may form part of a non-consumable (but removably engageable) substitute smoking article. For example, the tank may be configured for refilling.

Embodiments of the eighth aspect may have any one, or any combination insofar as they are compatible, of the optional features of the first to seventh aspects.

According to a ninth aspect there is provided a smoking substitute system comprising a housing defining a cavity for receipt of a liquid aerosol precursor, the housing comprising one or more elongate viewing regions extending along respective elongate axes, the one or more viewing regions arranged such that for both vertical and horizontal orientations of the housing the meniscus of the aerosol precursor is visible through a viewing region of the one or more viewing regions and extends transversely with respect to the elongate axis of the viewing region.

Such an arrangement may allow assessment of the level of aerosol precursor for multiple orientations of the housing. This may allow, for example, a user to determine the level of precursor when the housing is hand held (e.g., vertical) and when the housing is resting on a surface (e.g., horizontal). The provision of elongate viewing regions may limit the amount of light that enters the cavity (which could otherwise be detrimental to the aerosol precursor).

The term viewing region is intended to refer to a region that is translucent to allow visual inspection of the aerosol precursor. The housing is typically less translucent than the viewing region(s) and may be opaque. The less translucent/opaque housing will at least partly e.g., fully frame the viewing region(s) such that the viewing regions could be considered window portions within the housing.

The housing may define a longitudinal axis. For example, the housing may be elongate so as to extend along a longitudinal axis. In the vertical orientation the housing may be oriented such that the longitudinal axis is vertical. In the horizontal orientation the housing may be oriented such that the longitudinal axis is horizontal.

The one or more viewing regions may comprise an angled viewing region having a respective elongate axis that is oriented obliquely with respect to the longitudinal axis of the housing. In such an embodiment the meniscus may extend transversely across the angled viewing region in both the vertical and horizontal orientations.

The term "obliquely" is used to describe a direction that is neither parallel nor perpendicular to the longitudinal axis. Thus, the direction in which the oblique window portion extends consists of both a longitudinal component and a component that is transverse to the longitudinal component. In this respect, in each of the horizontal and vertical orientations, the meniscus of the precursor may also be oblique with respect to the elongate axis of the angled viewing region (i.e., when viewed through the angled viewing region).

The angled viewing region may extend on an angle of between 40 and 80 degrees with respect to the longitudinal axis. The angle may be between 50 and 70 degrees. The angle may be approximately 60 degrees.

The one or more viewing regions may comprise first and second viewing regions that are oriented so as to be orthogonal to one another. Thus, in a vertical orientation the meniscus may extend transversely across one of the first and second orthogonal viewing regions and in the horizontal orientation the meniscus may extend transversely across the other of the first and second orthogonal viewing regions.

One of the first and second orthogonal viewing regions may be oriented so as to be parallel to the longitudinal axis and the other of the first and second orthogonal viewing regions may be oriented so as to be perpendicular to the longitudinal axis.

The first and second orthogonal viewing regions may be joined (and/or may overlap). For example, the first and second orthogonal viewing regions may overlap so as to form a cross shape. In this respect, the first and second viewing regions may define a cross-shaped window formed in the housing.

The first and second orthogonal viewing regions may alternatively be joined at respective ends so as to form an L shape. Thus, the first and second orthogonal viewing regions may define an L-shaped window.

The first and second orthogonal viewing regions may alternatively be spaced from one another (i.e., separate viewing regions).

The width (perpendicular to the elongate axis) of each elongate viewing region may be between 1 mm and 7 mm. The width may be between 1 mm and 6 mm. The width of each viewing region may be between 2 and 5 mm.

The housing may comprise opposing and longitudinally extending front and rear walls spaced by opposing side walls extending therebetween. The distance between the front and rear walls may define a depth of the housing and the distance between the side walls may define a width of the housing. The width of the housing may be greater than the depth of housing.

A first viewing region of the one or more viewing regions may be formed in the front and/or rear wall and a second viewing region of the one or more viewing regions may be formed in one of the side walls.

When the system comprises an angled viewing region, the angled viewing region may be formed in a side wall of the housing. The angled viewing region may be a first angled viewing region and the one or more viewing regions may comprise a second angled viewing region. The second angled viewing region may be formed in an opposing side wall to the first angled viewing region.

The one or more viewing regions may comprise a transverse viewing region connecting the first and second angled viewing regions. The transverse viewing region may be formed in the front or rear wall of the housing.

The transverse viewing region may be a first transverse viewing region and the one or more viewing regions may further comprise a second transverse viewing region. The first transverse viewing region may connect respective first ends of the angled viewing regions and the second transverse viewing region may connect respective second ends (opposing the first ends) of the angled viewing region. The first transverse viewing region may be formed in one of the front and rear walls of the housing and the second transverse viewing region may be formed in the other of the first and rear walls of the housing.

Thus, the first and second angled viewing regions and the first and second transverse viewing regions may form a loop (i.e., in the form of a window) that extends about the housing (i.e., about the longitudinal axis).

When the one or more viewing regions comprises first and second orthogonal viewing regions, one of the first and second orthogonal viewing regions may be formed in the front or rear wall of the housing and the other of the first and second viewing regions may be formed in a side wall of the housing.

For example, the orthogonal viewing region formed in the front or rear wall may be transverse to the longitudinal axis of the housing and the orthogonal viewing region formed in the side wall may be parallel to the longitudinal axis. The transverse (orthogonal) viewing region may be formed in both the front and rear walls of the housing and may form a loop about the housing.

In some embodiments, the system may comprise a smoking substitute device and the housing may be a housing of the device. The housing may comprise a tank (or a tank portion) defining the cavity. In such embodiments, the tank may be configured so as to be refillable with aerosol precursor.

In other embodiments the system may comprise a consumable for a smoking substitute device (e.g., an e-cigarette device) and the housing may be a housing of the consumable. The housing may, for example, comprise a tank of the consumable (the cavity being the interior of the tank). The one or more viewing regions may be formed in a wall of the tank.

Alternatively, the system may comprise both a device and a consumable configured for engagement, and the housing may be a system housing (e.g., defined by a consumable housing and device housing).

The one or more viewing regions may form part of the consumable. The one or more viewing regions may form part of the device. The one or more viewing regions may form part of both the device and the consumable. For example, a viewing region of the one or more viewing regions may form part of the device (e.g., formed in a wall of the device) and another viewing region may form part of (e.g., formed in a wall of the consumable).

In some embodiments, at least one of the one or more viewing regions may be formed (i.e., only) when the consumable is received in the cavity of the device. In this respect, at least one of the viewing regions may be partly defined by each of the device and the consumable.

One or more walls of the tank (of the consumable) may be translucent. A portion of the tank may be received in a cavity of the device and, when received therein, a portion of the tank may remain outside of the cavity. The portion of the tank remaining outside of the cavity may define the one or more viewing regions.

The tank may be comprised a raised region that defines the one or more viewing regions when the portion of the tank is received in the cavity of the device. The raised region may define a lip for engagement with an edge of the device (e.g., the device housing) defining an opening to the cavity.

According to a tenth aspect there is provided a smoking substitute system comprising a longitudinally extending housing defining a cavity for receipt of a liquid aerosol precursor, and an elongate viewing region formed in the housing for viewing the level of aerosol precursor in the cavity, the viewing region extending obliquely with respect to the longitudinal axis defined by the housing.

The system of the tenth aspect may be as otherwise described above with respect to the ninth aspect.

According to an eleventh aspect there is provided a smoking substitute system comprising a housing defining a cavity for receipt of liquid aerosol precursor, and first and second elongate viewing regions formed in the housing for assessing the level of aerosol precursor stored in the reservoir, the first elongate viewing region orthogonal to the second elongate viewing region.

The system of the eleventh aspect may be as otherwise described above with respect to the ninth aspect.

The device (of any of the preceding aspects) may include a power source. The power source may be configured for electrical connection with the consumable when received in the cavity. Thus, for example, the power source may be configured to supply power to a heater, which may form part of the device or the consumable (e.g., for heating the aerosol precursor contained by the consumable).

The device (of any of the preceding aspects) may include a controller/processor.

A memory may be provided and may be operatively connected to the controller/processor. The memory may include non-volatile memory. The memory may include instructions which, when implemented, cause the controller to perform certain tasks or steps of a method.

The device (of any preceding aspect) may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WIFI®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to a heating element in response to airflow detection by the sensor. The control may be in the form of activation of the heating element in response to a detected airflow. The airflow sensor may form part of the device.

In a twelfth aspect, there is provided a system comprising: a smoking substitute device, the smoking substitute device comprising: a source of power, for providing power to a heater; a first charging connection, for charging the source of power, located at one end of the smoking substitute device; and a second charging connection, for charging the source of power, located on one or more lateral sides of the smoking substitute device; and a charging case, for charging the smoking substitute device, the charging case comprising: a battery, for providing power to the source of power in the smoking substitute device; and a cavity, within which the smoking substitute device is located, wherein the cavity includes a charging connection on at least one lateral side thereof, the charging connection being electrically connected to the second charging connection of the smoking substitute device.

Advantageously, a user can insert the smoking substitute device into the charging case in a single motion, which both: (i) mechanically links the smoking substitute device to the charging case; and (ii) establishes the electrical connection and so allows the smoking substitute device to charge. The device (of any preceding aspect) may be configured to receive a consumable as described below.

According to a thirteenth aspect, there is provided a substitute smoking system, including a substitute smoking device as described for any preceding aspect and a consumable for engagement with the substitute smoking device.

Optionally, the device is configured such that the consumable is for engagement with an engagement longitudinal end of the device, the engagement longitudinal end being opposite to the tapered end.

The device and the consumable may be configured to be physically coupled together. For example, the consumable may be at least partially received in a recess/cavity of the device, such that there is snap engagement between the device and the consumable. Alternatively, the device and the consumable may be physically coupled together by screwing one onto the other, or through a bayonet fitting.

Thus, the consumable may comprise one or more engagement portions for engaging with the device. In this way, one end of the consumable (i.e., the inlet end) may be coupled with the device, while an opposing end (i.e., the outlet end) of the consumable may define a mouthpiece.

The device may comprise an electrical interface for interfacing with a corresponding electrical interface of the consumable. One or both of the electrical interfaces may include one or more electrical contacts. Thus, when the device is engaged with the consumable (i.e., with the consumable received in a cavity of the device), the electrical interface may be configured to transfer electrical power from the power source to a heating element of the consumable. The electrical interface may also be used to identify the consumable from a list of known types. The electrical interface may additionally or alternatively be used to identify when the consumable is connected to the device.

The device may alternatively or additionally be able to detect information about the consumable via an RFID reader, a barcode or QR code reader. This interface may be able to identify a characteristic (e.g., a type) of the consumable. In this respect, the consumable may include any one or more of an RFID chip, a barcode or QR code, or memory within which is an identifier and which can be interrogated via the interface.

The consumable may comprise a tank (reservoir) for containing an aerosol precursor.

In a fourteenth aspect, there is provided a smoking substitute system comprising a device as described for any preceding aspect and a tank (reservoir) for containing an aerosol precursor.

In a fifteenth aspect there is provided a smoking substitute system comprising a smoking substitute device as described above with respect to the eighth aspect, and a smoking substitute consumable comprising a tank for engagement in the cavity of the device, the tank containing an aerosol precursor and being configured such that the aerosol precursor of the tank is visible through the aperture of the device when the tank is received in the cavity.

The end of the consumable received in the cavity may define an inlet end of the consumable, while an opposing end (i.e., the outlet end) of the consumable may define a mouthpiece.

The tank described in any preceding aspects may be defined by a tank housing comprising one or more tank walls. At least a portion of the tank housing may be translucent i.e., the tank walls may comprise a translucent portion (or may be entirely translucent). The translucent portion may be arranged such that, when the consumable is received in the cavity of the device, at least part of the translucent portion is aligned with the aperture (or apertures) formed in the housing (as defined in the twelfth aspect). In this way, the contents of the tank may be visible through the aperture and the translucent portion.

For example, the tank housing may comprise a window to allow a user to visually assess the quantity of e-liquid in the tank. The tank may be referred to as a "clearomizer" if it includes a window, or a "cartomizer" if it does not.

The consumable may comprise a retaining portion for retaining the consumable in the cavity of the device. The retaining portion may, for example, comprise (or may be) a protrusion protruding from a wall of the consumable. The protrusion may engage a corresponding feature (e.g., edge, recess, aperture) of the device to retain the consumable in the cavity. For example, the retaining portion may be configured to engage with the aperture formed in the housing of the device.

The retaining portion may form part of the one or more tank walls. The retaining portion may be or may form part of the translucent portion of the tank wall(s). The retaining portion may be configured to be received in the aperture when the consumable is received in the cavity.

The retaining portion may have the same shape (i.e., cross-sectional shape) as the aperture. In this respect, the retaining portion may substantially fill the aperture when received therein. The height of the retaining portion (from the wall from which it protrudes) may be substantially the same as the depth of the aperture. Thus, a distal end surface of the retaining portion may be configured so as to be flush with an outer surface of the housing wall when receiving in the aperture. Alternatively, the height of the retaining portion may be less than or greater than the depth of the aperture.

The consumable may be configured for snap engagement with the device. For example, the consumable may be configured to deform, or may comprise a deformable portion, to provide snap engagement with the device. The consumable may, for example, be configured to deform between a first position in which the retaining portion is retracted and the consumable is able to be received through the opening of the cavity, and a second position in which the retaining portion is extended for receipt in the aperture of the device housing.

The retaining portion may be deformable (i.e., able to flex). The retaining portion may comprise a ramp surface to facilitate snap engagement. For example, the ramp surface may be configured for engagement with the edge of the device defining the opening to the cavity. The ramp surface may be arranged such that, upon engagement with the edge, the retaining portion is caused to move to the retracted position by the ramp surface (i.e., so as to permit movement of the consumable into the cavity).

The smoking substitute system may comprise a passage for fluid flow therethrough. The passage may extend through (at least a portion of) the smoking substitute system, between openings that may define an inlet and an outlet of the passage. The outlet may be at a mouthpiece of the smoking substitute system. In this respect, a user may draw fluid (e.g., air) into and through the passage by inhaling at the outlet (i.e., using the mouthpiece).

The passage may extend longitudinally within the tank and a passage wall may define the inner wall of the tank. In this respect, the tank may surround the passage e.g., the tank may be annular. The passage wall may comprise longitudinal ribs extending along it. These ribs may provide support to the passage wall. The ribs may extend for the full length of the passage wall. The ribs may project (e.g., radially outwardly) into the tank.

In some embodiments, the system is a vaping smoking substitute system. The aerosol precursor may comprise an e-liquid, for example, comprising a base liquid and e.g., nicotine. The base liquid may include propylene glycol and/or vegetable glycerin.

The vaping smoking substitute system may comprise a vaporizer. The vaporizer may comprise a wick. The vaporizer may further comprise a heating element. The wick may comprise a porous material. A portion of the wick may be exposed to fluid flow in the passage. The wick may also comprise one or more portions in contact with e-liquid stored in the reservoir. For example, opposing ends of the wick may protrude into the reservoir and a central portion (between the ends) may extend across the passage so as to be exposed to fluid flow in the passage. Thus, fluid may be drawn (e.g., by capillary action) along the wick, from the reservoir to the exposed portion of the wick.

The heating element may be in the form of a filament wound about the wick (e.g., the filament may extend helically about the wick). The filament may be wound about the exposed portion of the wick. The heating element is electrically connected (or connectable) to a power source. Thus, in operation, the power source may supply electricity to (i.e., apply a voltage across) the heating element so as to heat the heating element. This may cause liquid stored in the wick (i.e., drawn from the tank) to be heated so as to form a vapor and become entrained in fluid flowing through the passage. This vapor may subsequently cool to form an aerosol in the passage.

As discussed above, the device of any of the first to fifth, seventh or ninth aspects may be configured for engagement with a consumable. The consumable may comprise components of the system that are disposable, and the device may comprise non-disposable or non-consumable components (e.g., power supply, controller, sensor, etc.) that facilitate the delivery of aerosol by the consumable. In such an embodiment, the aerosol former (e.g., e-liquid or tobacco substrate) may be replenished by replacing a used consumable with an unused consumable. The vaporizer/heating element may form part of the device, or part of a consumable.

In an alternative embodiment the system may be a non-consumable system, in which an aerosol former (e.g., e-liquid) may be replenished by re-filling a tank that is provided within the device (rather than replacing the consumable). In this embodiment, the consumable described above may instead be a non-disposable component that is integral with the device. In this embodiment, the only consumable portion may be e-liquid contained in the tank within the device. Access to the tank (for re-filling of the e-liquid) may be provided via e.g., an opening to the tank that is sealable with a closure (e.g., a cap).

In a sixteenth aspect, there is provided there is provided a smoking substitute system comprising a device as described in any of the preceding aspects and an aerosol generator unit.

Optionally, the aerosol generator unit may comprise an aerosol-forming substrate comprising tobacco material; and a heating element operable to heat the aerosol-forming substrate to generate an aerosol for entrainment in air flowing downstream from the aerosol generator.

According to a seventeenth aspect, there is provided a charging case for a substitute smoking device as described in relation to the first or second aspects aspect wherein the charging case includes a cavity of corresponding curvature to the main body of the device.

In a eighteenth aspect, embodiments of the present disclosure provide a charging case for charging a smoking substitute device, the charging case comprising: a battery, for providing power to a source of power in the smoking substitute device; and a cavity, for receiving the smoking substitute device, wherein the cavity includes a charging connection on at least one lateral internal side thereof, arranged to electrically connect to a corresponding charging connection on one or more lateral sides of the smoking substitute device.

The charging connection of the charging case may comprise a pair of electrical contacts. The electrical contacts may be located on opposite lateral sides of the cavity. The electrical contacts may be located on a same lateral side of the cavity. The electrical contacts may be resiliently biased in a direction into the cavity.

The disclosure includes the combination of the aspects and preferred features described except where such a combination is clearly impermissible or expressly avoided.

BRIEF DESCRIPTION OF THE DRAWINGS

So that further aspects and features thereof may be appreciated, embodiments will now be discussed in further detail with reference to the accompanying figures, in which.

DETAILED DESCRIPTION OF THE EMBODIMENTS

Aspects and embodiments will now be discussed with reference to the accompanying figures. Further aspects and embodiments will be apparent to those skilled in the art.

Figure 1A:
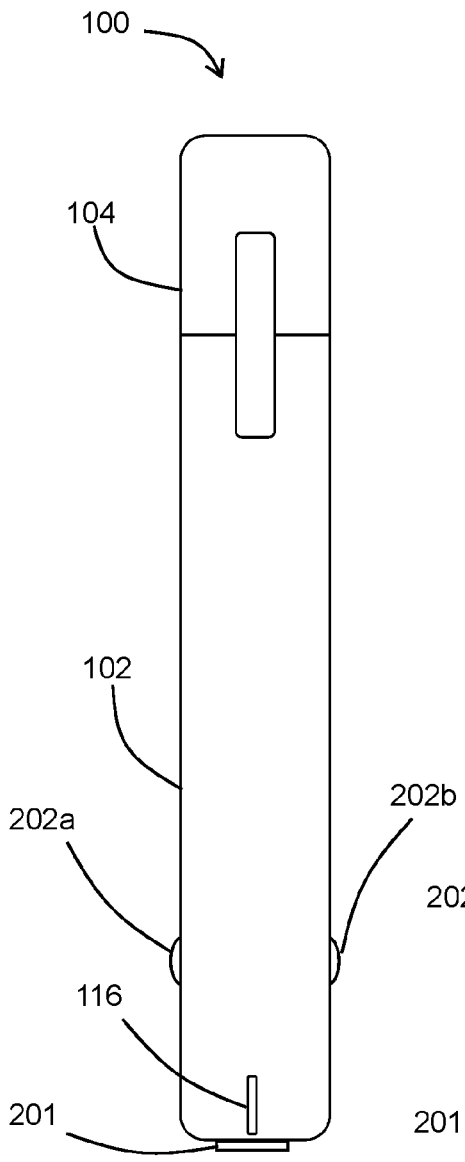
FIG. 1A is a front schematic view of a smoking substitute system.

FIG. 1A shows a first embodiment of a smoking substitute system 100. In this example, the smoking substitute system 100 includes a device 102 and an aerosol delivery consumable 104. The consumable 104 may alternatively be referred to as a "pod", "cartridge" or "cartomizer". It should be appreciated that in other examples (i.e., open systems), the device may be integral with the consumable. In such systems, a tank of the aerosol delivery system may be accessible for refilling the device.

Figure 1B:
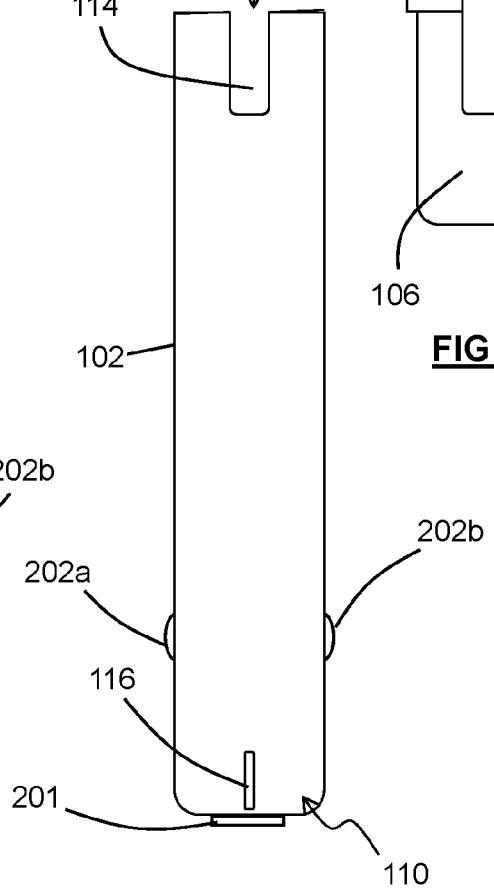
FIG. 1B is a front schematic view of a device of the system.
Figure 1C:
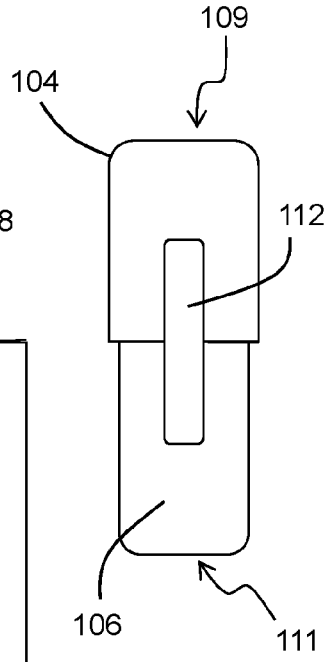
FIG. 1C is a front schematic view of a consumable of the system.

In this example, the smoking substitute system 100 is a closed system vaping system, wherein the consumable 104 includes a sealed tank 106 and is intended for single-use only. The consumable 104 is removably engageable with the device 102 (i.e., for removal and replacement). FIG. 1A shows the smoking substitute system 100 with the device 102 physically coupled to the consumable 104, FIG. 1B shows the device 102 of the smoking substitute system 100 without the consumable 104, and FIG. 1C shows the consumable 104 of the smoking substitute system 100 without the device 102.

The device 102 and the consumable 104 are configured to be physically coupled together by pushing the consumable 104 into a cavity at an upper end 108 of the device 102, such that there is an interference fit between the device 102 and the consumable 104. In other examples, the device 102 and the consumable may be coupled by screwing one onto the other, or through a bayonet fitting.

The consumable 104 includes a mouthpiece (not shown in FIG. 1A, 1B or 1C) at an upper end 109 of the consumable 104, and one or more air inlets (not shown) in fluid communication with the mouthpiece such that air can be drawn into and through the consumable 104 when a user inhales through the mouthpiece. The tank 106 containing e-liquid is located at the lower end 111 of the consumable 104.

The tank 106 includes a window 112, which allows the amount of e-liquid in the tank 106 to be visually assessed. The device 102 includes a slot 114 so that the window 112 of the consumable 104 can be seen whilst the rest of the tank 106 is obscured from view when the consumable 104 is inserted into the cavity at the upper end 108 of the device 102.

The lower end 110 of the device 102 also includes a light 116 (e.g., an LED) located behind a small translucent cover. The light 116 may be configured to illuminate when the smoking substitute system 100 is activated. Whilst not shown, the consumable 104 may identify itself to the device 102, via an electrical interface, RFID chip, or barcode.

The lower end 110 of the device 102 also includes a USB socket 201, which is usable to charge a battery within the device 102. The USB socket can also be used to transfer data to and from the device, for example to update firmware thereon. In addition to the USB socket 201, a second charging connection, formed of contacts 202*a* and 202*b*, is provided on opposing lateral sides of the device 102. Contacts 202*a* and 202*b* electrically connect to a source of power, for example in a carry case suitable for the smoking substitute device 102. Contacts 202*a* and 202*b* may be spring-loaded, and biased to an outwards position. Alternatively, the contacts may be flat plate contacts so as to conform to the outer shape of the device.

Figure 8A:
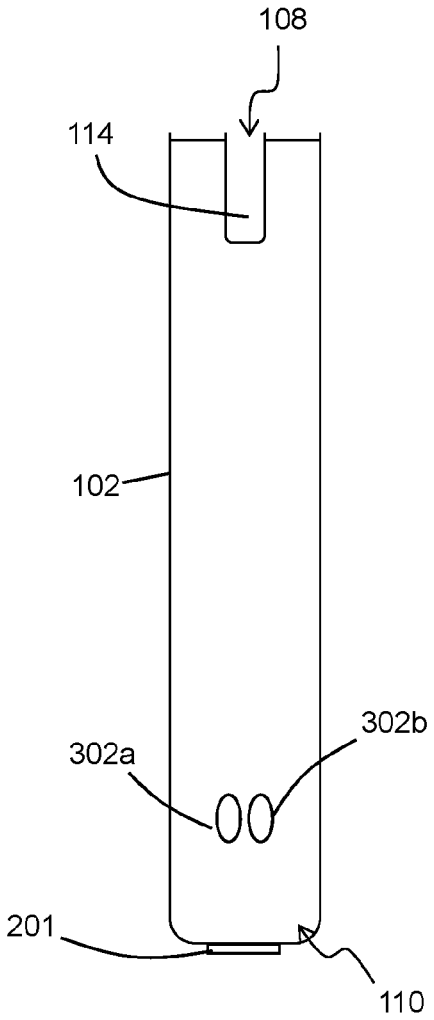
FIG. 8A is a rear schematic view of a variant smoking substitute device.
Figure 8B:
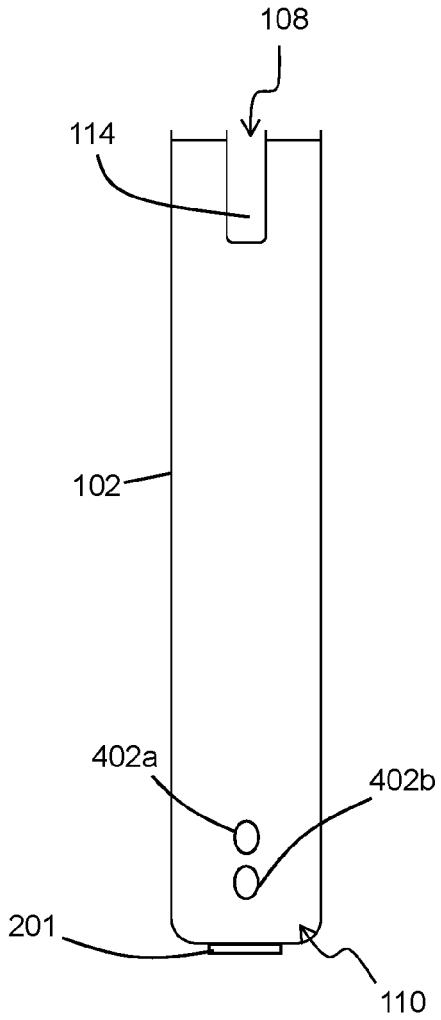
FIG. 8B is a rear schematic view of a variant smoking substitute device.

FIGS. 8A and 8B show variant smoking substitute devices 102, where like features are indicated by like reference numerals. In FIG. 8A, the electrical contacts 302*a* and 302*b* of the second charging connection are provided on a same lateral side of the device 102. In this instance, the contacts are horizontally spaced, so as to be provided in a row extending across a width of the device (left-right in FIG. 8A).

In FIG. 8B, the electrical contacts 402*a* and 402*b* of the second charging connection are again provided on a same lateral side of the device 102. However, in this instance, the contacts are vertically spaced, so as to be provided in a row extending along a length of the device away from the first charging connection 201 (up-down in FIG. 8B).

Figure 2A:
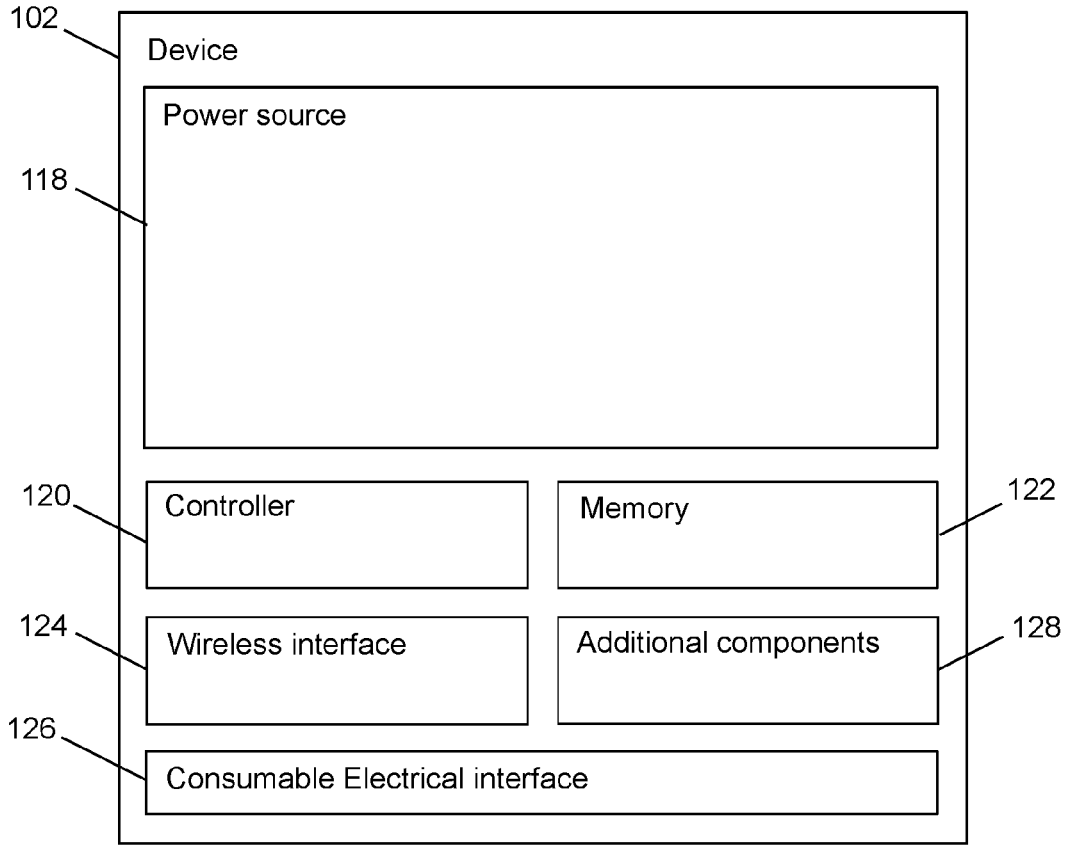
FIG. 2A is a schematic of the components of the device.
Figure 2B:
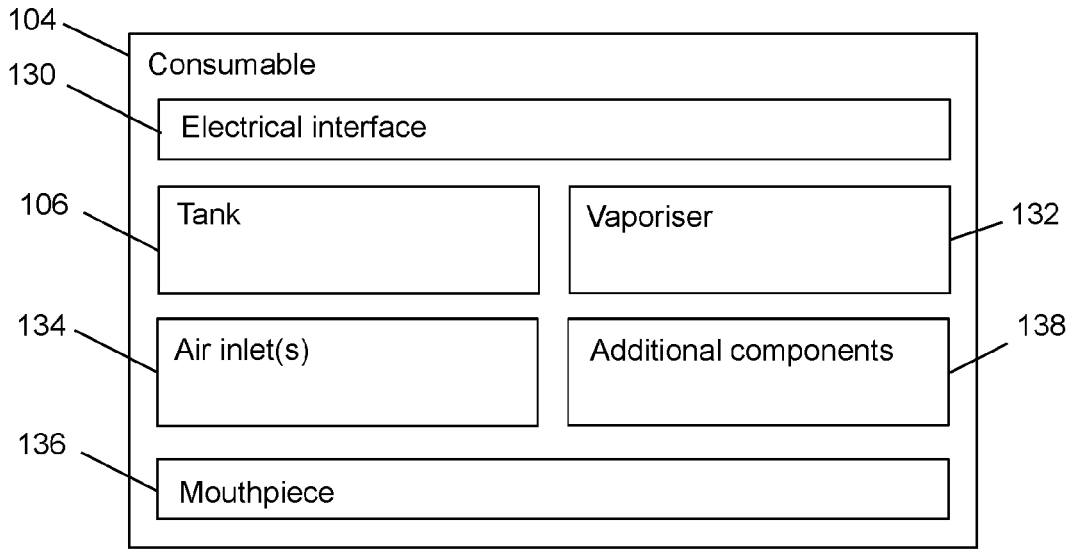
FIG. 2B is a schematic of the components of the consumable.

FIGS. 2A and 2B are schematic drawings of the device (main body) 102 and consumable 104. As is apparent from FIG. 2A, the device 102 includes a power source 118, a controller 120, a memory 122, a wireless interface 124, an electrical interface 126, and, optionally, one or more additional components 128.

The power source 118 is preferably a battery, more preferably a rechargeable battery. The controller 120 may include a microprocessor, for example. The memory 122 preferably includes non-volatile memory. The memory may include instructions which, when implemented, cause the controller 120 to perform certain tasks or steps of a method.

The wireless interface 124 is preferably configured to communicate wirelessly with another device, for example a mobile device, e.g., via Bluetooth®. To this end, the wireless interface 124 could include a Bluetooth® antenna. Other wireless communication interfaces, e.g., WIFI®, are also possible. The wireless interface 124 may also be configured to communicate wirelessly with a remote server.

The electrical interface 126 of the device 102 may include one or more electrical contacts. The electrical interface 126 may be located in a base of the cavity in the upper end 108 of the device 102. When the device 102 is physically coupled to the consumable 104, the electrical interface 126 is configured to transfer electrical power from the power source 118 to the consumable 104 (i.e., upon activation of the smoking substitute system 100).

The electrical interface 126 may be configured to receive power from a charging station when the device 102 is not physically coupled to the consumable 104 and is instead coupled to the charging station.

The electrical interface 126 may also be used to identify the consumable 104 from a list of known consumables. For example, the consumable 104 may be a particular flavor and/or have a certain concentration of nicotine (which may be identified by the electrical interface 126). This can be indicated to the controller 120 of the device 102 when the consumable 104 is connected to the device 102. Additionally, or alternatively, there may be a separate communication interface provided in the device 102 and a corresponding communication interface in the consumable 104 such that, when connected, the consumable 104 can identify itself to the device 102.

The additional components 128 of the device 102 may comprise the light 116 discussed above.

The additional components 128 of the device 102 may also comprise a charging port e.g., in the form of the first charging connection and the second charging connection (e.g., USB or micro-USB port) configured to receive power from the charging station (i.e., when the power source 118 is a rechargeable battery). This may be located at the lower end 110 of the device 102.

Alternatively, in some embodiments, the electrical interface 126 discussed above may be configured to act as a charging port configured to receive power from the charging station such that a separate charging port is not required.

The additional components 128 of the device 102 may, if the power source 118 is a rechargeable battery, include a battery charging control circuit, for controlling the charging of the rechargeable battery. However, a battery charging control circuit could equally be located in the charging station (if present).

The additional components 128 of the device 102 may include a sensor, such as an airflow (i.e., puff) sensor for detecting airflow in the smoking substitute system 100, e.g., caused by a user inhaling through a mouthpiece 136 of the consumable 104. The smoking substitute system 100 may be configured to be activated when airflow is detected by the airflow sensor. This sensor could alternatively be included in the consumable 104. The airflow sensor can be used to determine, for example, how heavily a user draws on the mouthpiece or how many times a user draws on the mouthpiece in a particular time period.

The additional components 128 of the device 102 may include a user input, e.g., a button. The smoking substitute system 100 may be configured to be activated when a user interacts with the user input (e.g., presses the button). This provides an alternative to the airflow sensor as a mechanism for activating the smoking substitute system 100.

The additional components 128 of the device 102 further comprise a means for delivering a haptic feedback to a user. This haptic feedback may be, for example, a vibration or sequence of vibrations. The means for delivering a haptic feedback may be a vibration generator, which may comprise an electric motor having an eccentrically mounted weight on a shaft. Other means for vibration generation are also possible, including, for example, a linear actuator or a piezo-electric element. The haptic feedback may be generated as a sequence of activations/vibrations of the vibration generator or other means for delivering a haptic feedback. The means for delivering a haptic feedback may be controlled by the controller 120. The specific sequence of vibrations or activations forming the haptic feedback may be configurable or selectable by a user of the device 102, and one or more sequences of activations or vibrations may be stored in a memory, such as the memory 122 of the device 102. The means for delivering a haptic feedback may be switchable between an operating (ON) state wherein the haptic feedback is delivered and a non-operating (OFF) state wherein the haptic feedback is not delivered.

The haptic feedback is generated in response to a physical stimulus from a user of the device 102, in particular a movement of the device 102. In some embodiments, the physical stimulus from the user may be a tap or shake of the device, a sequence of taps or shakes, or a movement of the device to a particular orientation or along a specified motion path. The movement may be detectable or measurable by a movement detector such as one or more tilt switches and/or one or more accelerometers and/or one or more g-sensors. Such a physical stimulus may be detectable even without direct contact between the user and the device 102. For example, even if the device 102 is located in a pocket of an article of clothing worn by the user, or in a bag carried by the user, and the user can deliver the physical stimulus by tapping the device through the material constituting the article of clothing or the bag. This can therefore allow the user to determine whether or not the device 102 is present without needing to remove it from the pocket or bag.

The haptic feedback is not limited to an indication that the device 102 is present. For example, the haptic feedback may be used, for example, to indicate that the device 102 is active (i.e., ready to be used to generate a vapor), to distinguish between devices 102 (i.e., generate a user-specific vibration sequence), or to be used as a distraction aid. The device 102 may be able to detect or identify multiple different movements, such as tap or shake sequences. Each movement identified as a predetermined movement may be configured or configurable to generate a different response. For example, tapping the device 102 may cause a first haptic feedback to be generated (e.g., to indicate that the device is present), tilting the device 102 (as a user might while picking up the device) might cause a second haptic feedback to be generated (e.g., a feedback to indicate that the device is ready to operate), shaking the device 102 might generate a third haptic feedback response to be generated (e.g., a device identifying user-specific vibration sequence). A number of taps or shakes of the device may trigger a corresponding number of activations of the haptic feedback generator, which may be the same as the number of tapes or shakes. For example, a double-tap of the device 102 may trigger a sequence of two activations of the haptic feedback generator. Other movement sequences and activation sequences are also possible.

The haptic feedback is generated by a haptic feedback unit, which includes at least the means for generating the vibration, and may additionally comprise the movement detector, and/or a haptic feedback unit controller. Alternatively, the haptic feedback unit may be controlled by the controller 120 of the device 102. The movement detector may be separate from the haptic feedback unit, and may act as an input to the haptic feedback unit or to the controller 120.

The haptic feedback operating state and/or response sequence may be configurable by use of a switch or other control means provided in the device 102. Additionally, or alternatively, the haptic feedback operating state and/or response sequence may be configurable by a signal from an external device received through the wireless interface 124.

As shown in FIG. 2B, the consumable 104 includes the tank 106, an electrical interface 130, a vaporizer 132, one or more air inlets 134, a mouthpiece 136, and one or more additional components 138.

The electrical interface 130 of the consumable 104 may include one or more electrical contacts. The electrical interface 126 of the device 102 and an electrical interface 130 of the consumable 104 are configured to contact each other and thereby electrically couple the device 102 to the consumable 104 when the lower end 111 of the consumable 104 is inserted into the upper end 108 of the device 102 (as shown in FIG. 1A). In this way, electrical energy (e.g., in the form of an electrical current) is able to be supplied from the power source 118 in the device 102 to the vaporizer 132 in the consumable 104.

The vaporizer 132 is configured to heat and vaporize e-liquid contained in the tank 106 using electrical energy supplied from the power source 118. As will be described further below, the vaporizer 132 includes a heating filament and a wick. The wick draws e-liquid from the tank 106 and the heating filament heats the e-liquid to vaporize the e-liquid.

The one or more air inlets 134 are preferably configured to allow air to be drawn into the smoking substitute system 100, when a user inhales through the mouthpiece 136. When the consumable 104 is physically coupled to the device 102, the air inlets 134 receive air, which flows to the air inlets 134 along a gap between the device 102 and the lower end 111 of the consumable 104.

In operation, a user activates the smoking substitute system 100, e.g., through interaction with a user input forming part of the device 102 or by inhaling through the mouthpiece 136 as described above. Upon activation, the controller 120 may supply electrical energy from the power source 118 to the vaporizer 132 (via electrical interfaces 126, 130), which may cause the vaporizer 132 to heat e-liquid drawn from the tank 106 to produce a vapor which is inhaled by a user through the mouthpiece 136.

An example of one of the one or more additional components 138 of the consumable 104 is an interface for obtaining an identifier of the consumable 104. As discussed above, this interface may be, for example, an RFID reader, a barcode, a QR code reader, or an electronic interface which is able to identify the consumable. The consumable 104 may, therefore include any one or more of an RFID chip, a barcode or QR code, or memory within which is an identifier and which can be interrogated via the electronic interface in the device 102.

It should be appreciated that the smoking substitute system 100 shown in FIGS. 1A to 2B is just one exemplary implementation of a smoking substitute system. For example, the system could otherwise be in the form of an entirely disposable (single-use) system or an open system in which the tank is refillable (rather than replaceable).

Figure 3:
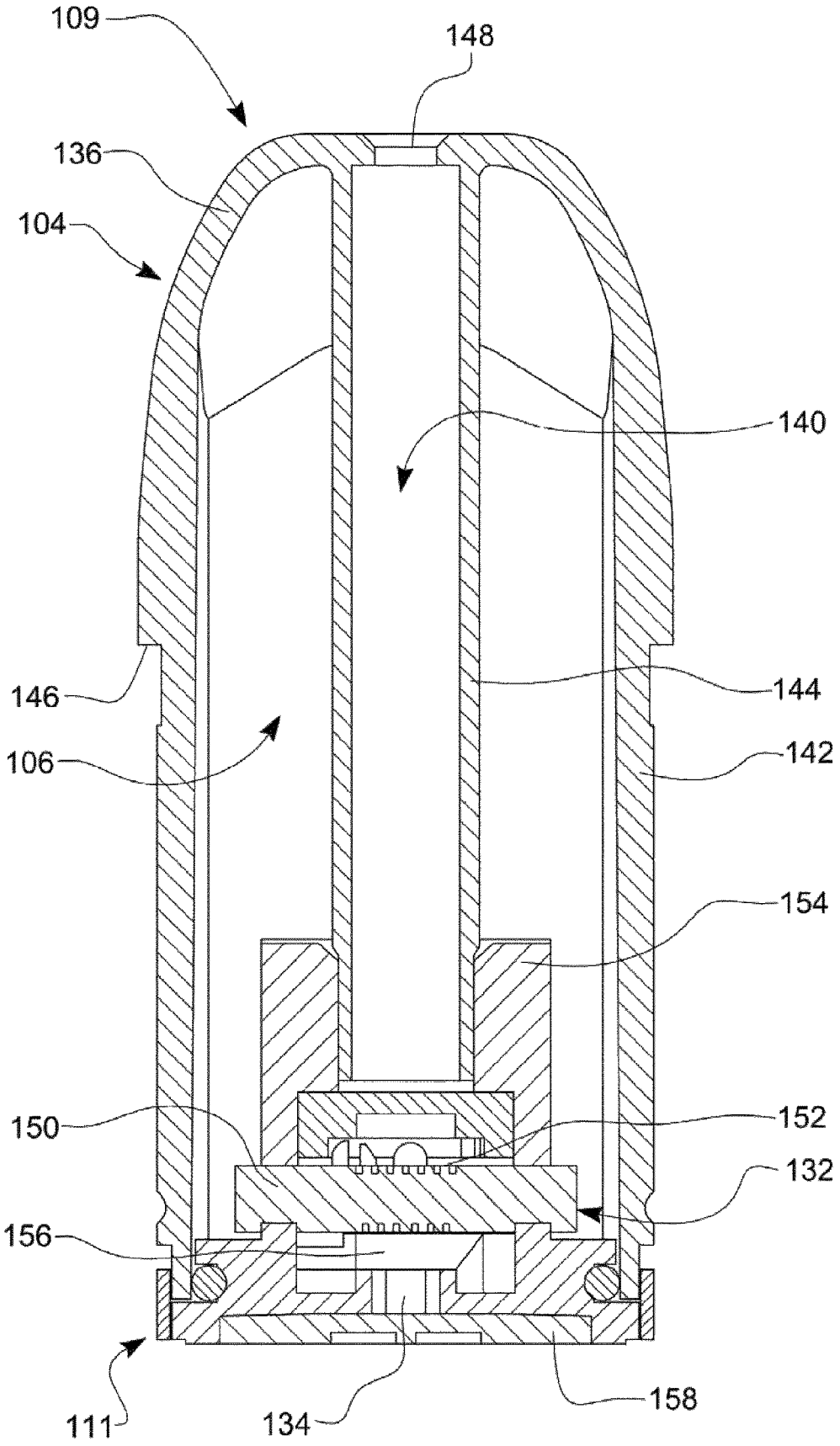
FIG. 3 is a section view of the consumable.

FIG. 3 is a section view of the consumable 104 described above. The consumable 104 comprises a tank 106 for storing e-liquid, a mouthpiece 136 and a passage 140 extending along a longitudinal axis of the consumable 104. In the illustrated embodiment the passage 140 is in the form of a tube having a substantially circular transverse cross-section (i.e., transverse to the longitudinal axis). The tank 106 surrounds the passage 140, such that the passage 140 extends centrally through the tank 106.

A tank housing 142 of the tank 106 defines an outer casing of the consumable 104, whilst a passage wall 144 defines the passage 140. The tank housing 142 extends from the lower end 111 of the consumable 104 to the mouthpiece 136 at the upper end 109 of the consumable 104. At the junction between the mouthpiece 136 and the tank housing 142, the mouthpiece 136 is wider than the tank housing 142, so as to define a lip 146 that overhangs the tank housing 142. This lip 146 acts as a stop feature when the consumable 104 is inserted into the device 102 (i.e., by contact with an upper edge of the device 102).

The tank 106, the passage 140 and the mouthpiece 136 are integrally formed with each other so as to form a single unitary component and may e.g., be formed by way of an injection molding process. Such a component may be formed of a thermoplastic material such as polypropylene.

The mouthpiece 136 comprises a mouthpiece aperture 148 defining an outlet of the passage 140. The vaporizer 132 is fluidly connected to the mouthpiece aperture 148 and is located in a vaporizing chamber 156 of the consumable 104. The vaporizing chamber 156 is downstream of the inlet 134 of the consumable 104 and is fluidly connected to the mouthpiece aperture 148 (i.e., outlet) by the passage 140.

The vaporizer 132 comprises a porous wick 150 and a heater filament 152 coiled around the porous wick 150. The wick 150 extends transversely across the chamber vaporizing 156 between sidewalls of the chamber 156 which form part of an inner sleeve 154 of an insert 158 that defines the lower end 111 of the consumable 104 that connects with the device 102. The insert 158 is inserted into an open lower end of the tank 106 so as to seal against the tank housing 142.

In this way, the inner sleeve 154 projects into the tank 106 and seals with the passage 140 (around the passage wall 144) so as to separate the vaporizing chamber 156 from the e-liquid in the tank 106. Ends of the wick 150 project through apertures in the inner sleeve 154 and into the tank 106 so as to be in contact with the e-liquid in the tank 106. In this way, e-liquid is transported along the wick 150 (e.g., by capillary action) to a central portion of the wick 150 that is exposed to airflow through the vaporizing chamber 156. The transported e-liquid is heated by the heater filament 152 (when activated e.g., by detection of inhalation), which causes the e-liquid to be vaporized and to be entrained in air flowing past the wick 150. This vaporized liquid may cool to form an aerosol in the passage 140, which may then be inhaled by a user.

Figure 9A:
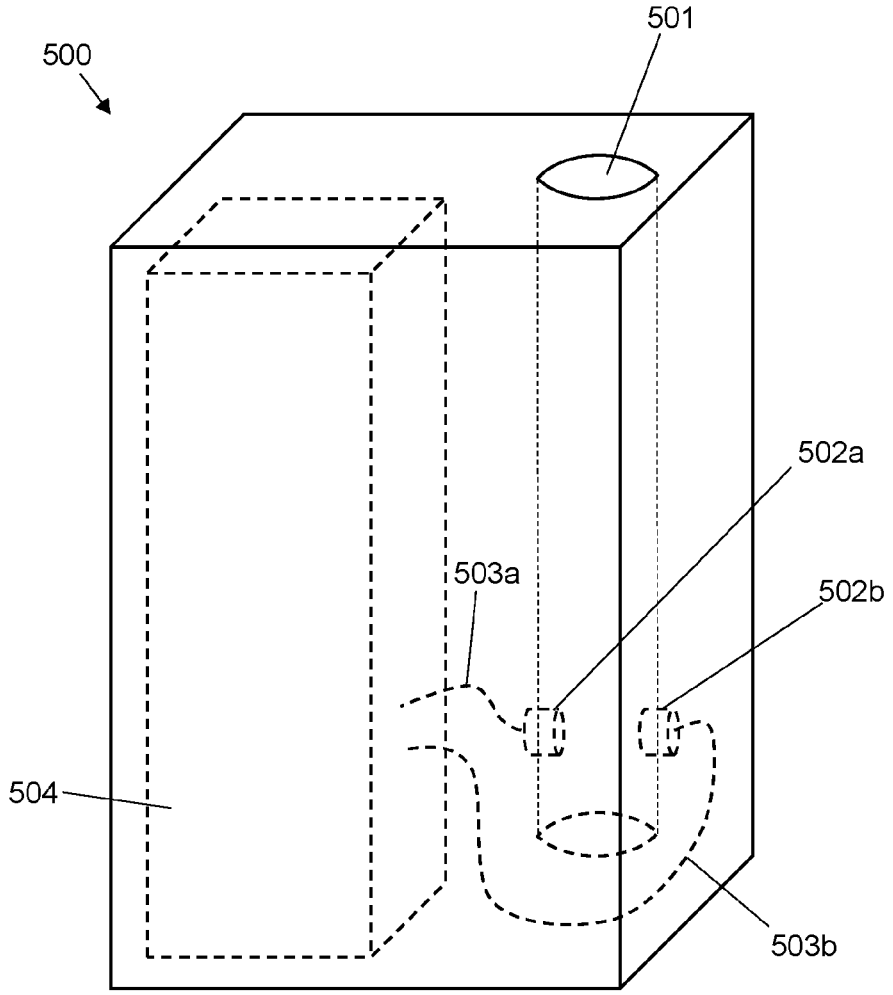
FIG. 9A is a schematic view of a charging case.

FIG. 9A shows a charging case 500 for use with the smoking substitute device discussed above. The charging case has a cavity 501, with an aperture located in one surface of the charging case through which the smoking substitute device can be introduced. Within the cavity, on two lateral sides of the internal surface thereof, are electrical connectors 502*a* and 502*b*. These electrically connect with connectors 202*a* and 202*b* on device 103. Wires 503*a* and 503*b* are connected to the connectors 502*a* and 502*b*, and electrically interconnect them to battery 504 (which may contain charging electronics, for example voltage regulators and/or processors for controlling the charging process).

Electrical connectors 502*a* and 502*b* may be pogo pin connectors, in that they may be biased towards the interior of the cavity 501 so as to ensure a reliable connection between themselves and the corresponding connectors on device 103.

Figure 9B:
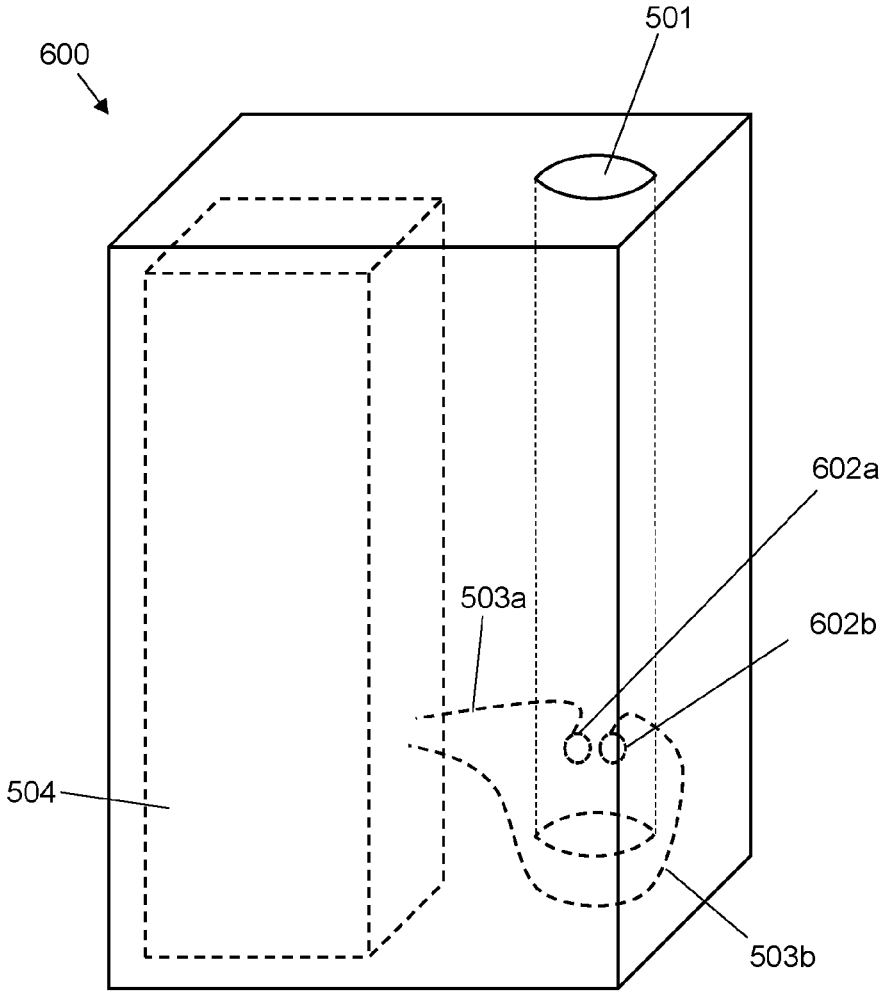
FIG. 9B is a schematic view of a variant charging case.

FIG. 9B shows a variant charging case 600. Where case 600 shares features with case 500, like features are indicated by like reference numerals. In contrast to the case 500 shown in FIG. 5A, electrical connectors 602*a* and 602*b* are located on a same lateral side of the interior of the cavity 501.

Figure 4:
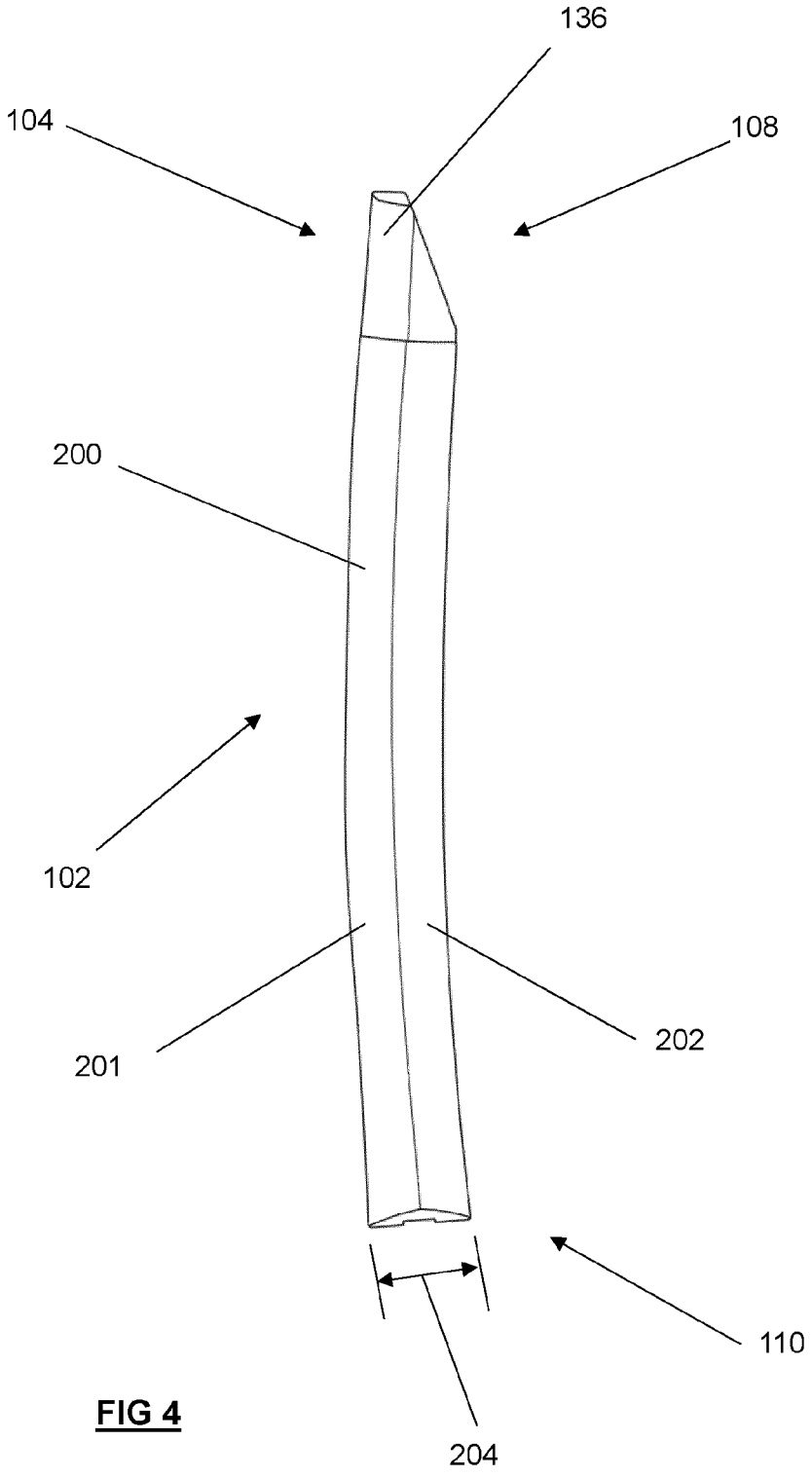
FIG. 4 is a side view of a smoking substitute device in accordance with an embodiment.

FIG. 4 illustrates an embodiment where the smoking substitute device 102 is engaged with a consumable 104 at the upper end 108 of the device 200. The consumable 104 includes the mouthpiece 136. The device 200 includes a charging port (e.g., USB port) at the lower end 110 of the device 200. The device 200 may further include the secondary charging connections discussed previously, on a same lateral side of the device (and so not visible in this view).

The device 102 is generally defined, in terms of device shape, by a main body housing 200. The main body housing 200 houses a number of the device components. The particular, the main body housing 200 houses the battery for powering operations of the device 102 and supplying electrical power to the consumable 104. The battery may be a generally straight (in the longitudinal dimension) elongate rectangular shape. In some embodiments, the longitudinal length of the battery may be between 50 millimeters and 100 millimeters.

The main body housing 200 receives a portion of the consumable 104 to thereby engage with the consumable 104.

The main body housing 200 is generally elongate—"long and thin". The longitudinal dimension is orientated along the longest axis of the main body housing 200. The main body housing 200 has a total length in the longitudinal dimension. The total length may be between 5 and 20 centimeters, more preferably between 10 centimeters and 20 centimeters.

Perpendicular to the longitudinal dimension is the transverse dimension ("into the page" in FIG. 4). In a plane in the transverse dimension, the main body device 200 has a depth 204 and a width (which is into/out of the page in respect of FIG. 5). In some embodiments, the width of the main body housing 200 is larger than the main body depth 204. In other words, in some embodiments, the transverse cross sectional shape of the main body housing 200 is elongate. In some embodiments the main body depth 204 of the main body housing 200 varies along the longitudinal dimension.

In some embodiments, as in that of FIG. 4, the transverse cross-sectional shape is generally constant along at least a portion of the length of the main body housing 200.

The main body housing 200 is generally curved along its length. That is, a hypothetical line 203 (see FIG. 5) passing through the centroid of the main body housing 200, aligned with the longitudinal axis of the main body housing 200, is curved and fixed i.e., has only a single, unmovable configuration. In the embodiment the main body housing 200 is curved along the full length. However, in some embodiments, the main body housing 200 is only curved in a curved section or portion of the longitudinal length of the main body housing 200 between the upper 108 and lower end 110. In such embodiments, longitudinally outside of the curved portion, the main body housing 200 may be substantially straight.

The radius of curvature of the main body housing 200 of the embodiment of FIG. 4 is 550 millimeters. However, in some embodiments the radius of curvature of the main body housing 200 is different. In some embodiments, the radius of curvature of the main body housing is between 3000 millimeters and 100 millimeters, preferably between 2000 millimeters and 200 millimeters, more preferably between 1000 and 200 millimeters, more preferably between 800 and 300 millimeters.

In some embodiments the radius of curvature of the main body housing 200 is substantially constant along the length of the main body housing 200. In some embodiments the radius of curvature of the main body housing 200 varies along the length of the main body housing 200.

When placed on a flat surface, e.g., a table top, the curved main body housing 200 therefore bows upward away from the table surface. This permits the user to easily grasp the device 102, relative to a device having a straight main body housing. The device 102 is also ergonomically beneficial, the curvature of the device allowing for more comfortable compliance with the curvature of a user's body, for example the upper leg when placed in a pocket.

Figure 5:
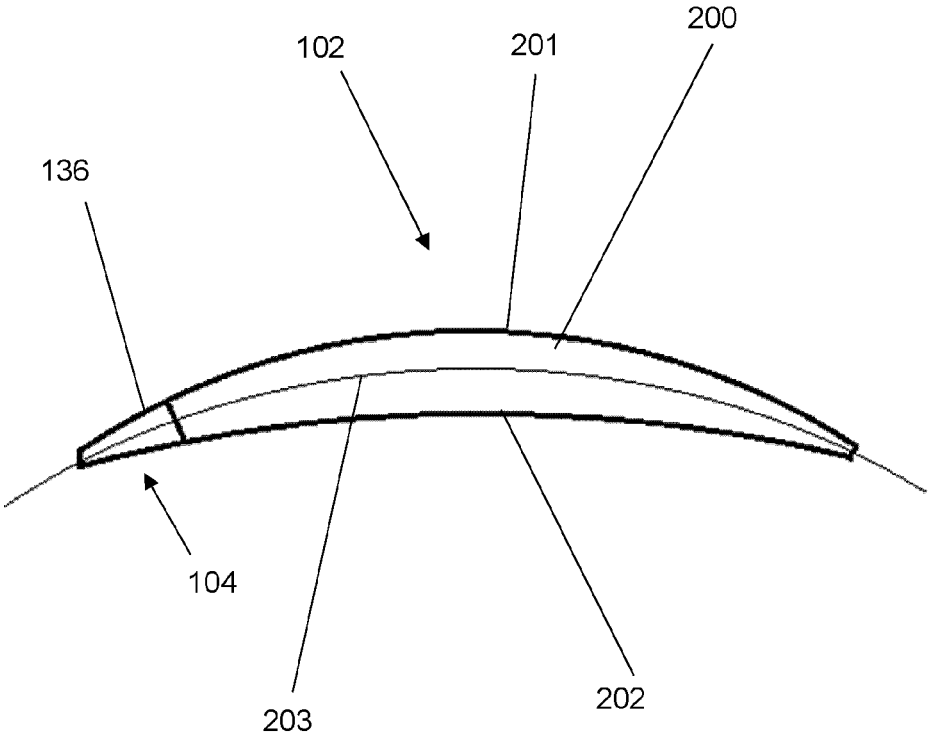
FIG. 5 is a schematic cross section of a smoking substitute device in accordance with an embodiment.

FIG. 5 shows a schematic illustration of a longitudinal cross-section of a device 102 according to an embodiment. The device 102 is shown engaged with a consumable 104. The main body housing 200 is illustrated with the hypothetical line 203 passing along the longitudinal dimension. This line 203 illustrates the curvature of the main body housing 200.

The main body housing 200 has an upper surface 201 and oppositely directed lower surface 202. The lower surface 202 has a lower surface radius of curvature in the longitudinal dimension which is larger than the radius of curvature in the longitudinal dimension of the upper surface 203. In other words, the curvature of the lower surface 202 is less severe than the upper surface 201. This forms a main body housing 200 that terminally tapers at each longitudinal end, noting that at one end of the housing 200, the consumable 104 is engaged, so it is consumable 104 that includes the terminal taper of the combined consumable 104 and device 102. In some embodiments, the upper surface 201 and/or lower surface 202 taper together separately from their longitudinal curvature as defined above, and the terminal taper is not resultant from the curvature of the upper 201 and lower surface 202 as defined above.

In some embodiments, the longitudinal distance across the upper surface 201 is longer than the longitudinal distance across the lower surface 202. This may permit a user to engage with a terminal transverse edge of the upper surface 201 more easily, since it may slightly overhang the lower surface 202 making the device 102 easier to pick up.

In some embodiments, the device 102 includes a user feedback means, e.g., a visual user output indicator, which may be located on the upper surface 201. The user feedback means may include one or more lights.

Figure 6:
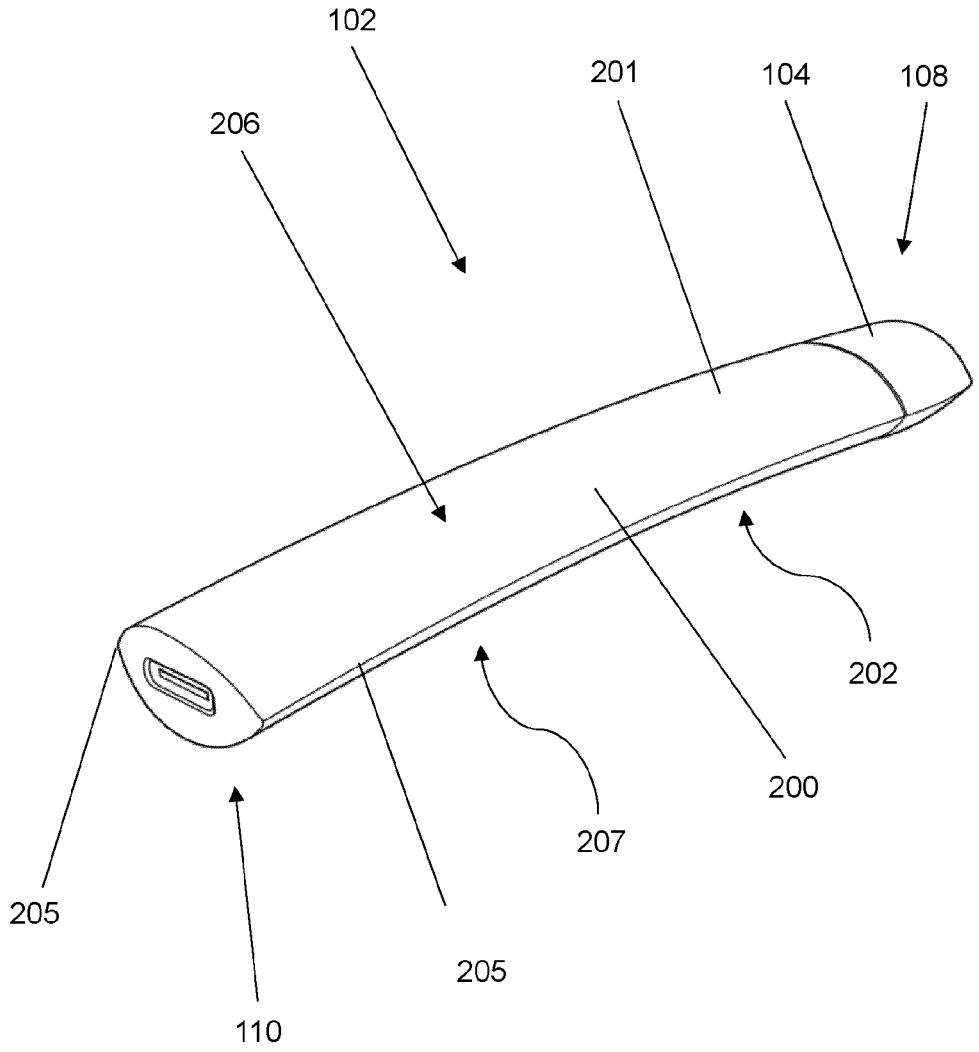
FIG. 6 is perspective view of a smoking substitute device in accordance with an embodiment.

FIG. 6 shows a perspective view of the device 102 shown engaged with the consumable 104 at the upper end 108. The device 102 includes a charging port at the lower end 110.

The upper surface 201 of the main body housing 200 is curved in the transverse dimension. The lower surface 202 of the main body housing 200 is curved in the transverse dimension. The curvatures of the upper surface 201 and lower surface 202 are of the opposite sense to one another. Both upper and lower surfaces 201, 202 are therefore convex in the transverse dimension. The radius of curvature of the upper surface 201 in the transverse dimension is greater than half the depth of the main body housing 200. The radius of curvature of the lower surface 202 in the transverse dimension is greater than half the depth of the main body housing 200. This leads to a mandorla-, eye-, or lemon-shaped transverse cross sectional shape of the main body housing 200.

In some embodiments the upper surface 201 and the lower surface 202 are curved in the same sense, which leads to one surface being convex and the other being concave.

The upper surface 201 and lower surface 202 meet at two transverse edges 205. The transverse edges 205 have a radius of curvature that is significantly smaller than the radius of curvature of either the upper 201 or lower surface 202. This leads to the transverse edges 205 being substantially "pointed" or "sharp". The transverse edges 205 may have a radius of curvature in the transverse dimension of less than 10 millimeters, preferably less than 5 millimeters, preferably less than 2 millimeters, preferably less than 1 millimeter.

As illustrated in FIG. 6, the transverse edges 205 extend substantially the full longitudinal length of the main body housing 200. However, in some embodiments, the transverse edges 205 may only extend along a longitudinal portion of the main body housing 200. The presence of the edges 205, relative to the upper surface 201 and the lower surface 202, permit the user to easily grasp the device. This is also true regardless of which of the upper or lower surface faces downwards towards a surface on which the device sits (e.g., a table-top). Such a main body housing 200 shape is also ergonomically beneficial, and may lead to comfortable positioning in hand, for example because the transverse edges locate at the joints of the fingers.

The main body housing 200 is formed from upper and lower housing sections 206, 207. The upper and lower housing sections 206, 207 are interconnected to one another (for examples, via a snap fit or by gluing) along the transverse edges 205. Such a configuration may improve the ease of manufacture of the device 102. In some embodiments the main body housing 200 is formed in an extrusion process.

The upper surface 201 of the main body housing 200 may include a user feedback means, for example one or more lights. The lower surface 202 of the main body housing 200 may include a window or notch through which a liquid level in the consumable 104 may be assessed by a user. The lower surface 202 may include a charging means. The charging means may include a pair of electrical contacts engagement with a corresponding pair of charging contacts. The charging contacts may, for example, be part of a charge case or dock.

A user feedback means may be provided along one or both of the transverse edges 205. In some embodiments the user feedback means is elongate along the longitudinal dimension. In some embodiments, the user feedback means is a visual feedback means. For example, an elongate light (or sequence of lights) may be provided that runs along at least a longitudinal portion of one of the edges 205. An elongate user feedback means may mean that it is less likely to be inadvertently obscured when the device 102 is grasped by a user.

Figure 7:
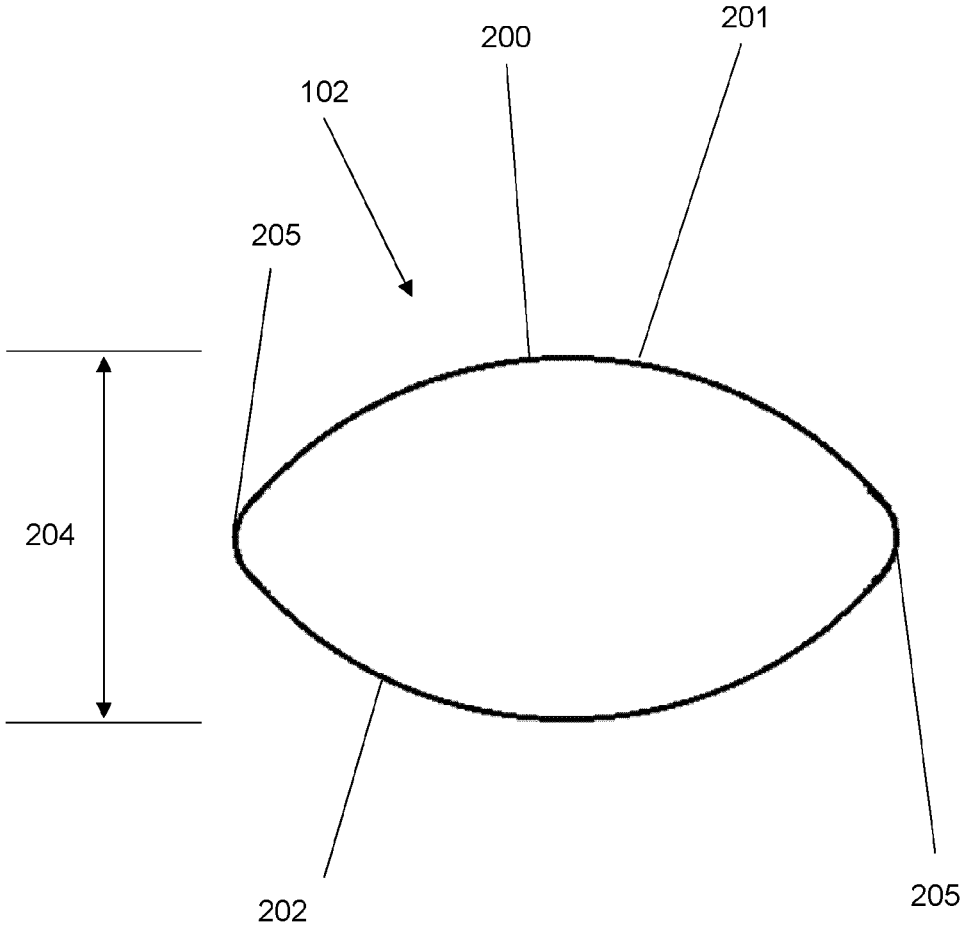
FIG. 7 is a schematic cross section of a smoking substitute device in accordance with an embodiment.

FIG. 7 illustrates a schematic transverse cross section through the device 102 of FIG. 6, in accordance with an embodiment. The upper surface 201 and lower surface 202 are shown meeting at the transverse edges 205 on either side of the main body housing 200. The radius of curvature of the upper surface 201 is larger than half the main body depth 204 of the main body 200. The radius of curvature of the lower surface 202 is larger than half the main body depth 204 of the main body 200. This leads to the mandorla-, eye- or lemon-shaped transverse cross sectional shape of the main body housing 200. The radius of curvature in the transverse dimension of the upper surface 201 is equal to the radius of curvature in the transverse dimension of the lower surface 202. As described above, in some embodiments, the radius of curvature of the upper surface 201 is different from the radius of curvature of the lower surface 202.

The radius of curvature of the upper surface 201 may be between 10 millimeters and 50 millimeters, preferably between 10 and 40 millimeters, preferably between 10 millimeters and 30 millimeters, preferably been 10 and 20 millimeters, more preferably between 10 millimeters and 15 millimeters, more preferably substantially 13.5 millimeters.

It is noted that the longitudinal curvature described in respect of FIGS. 4 and 5 is independently applicable to a device from the curvature described in respect of FIGS. 6 and 7. In some embodiments, the device is curved in both respects.

Figure 10A:
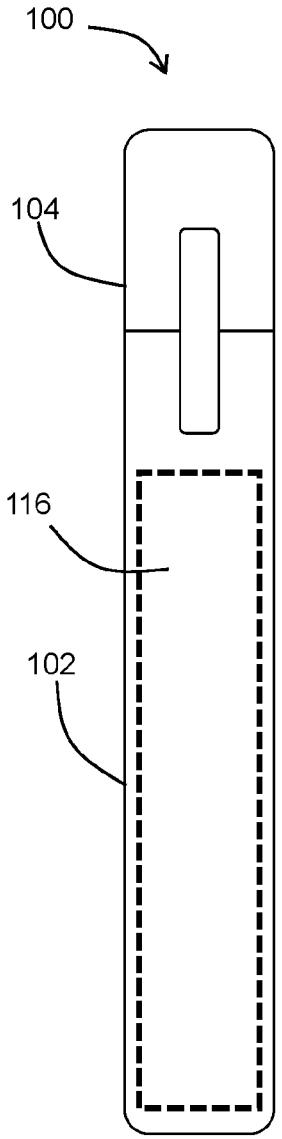
FIG. 10A is a front schematic view of a smoking substitute system.
Figure 10B:
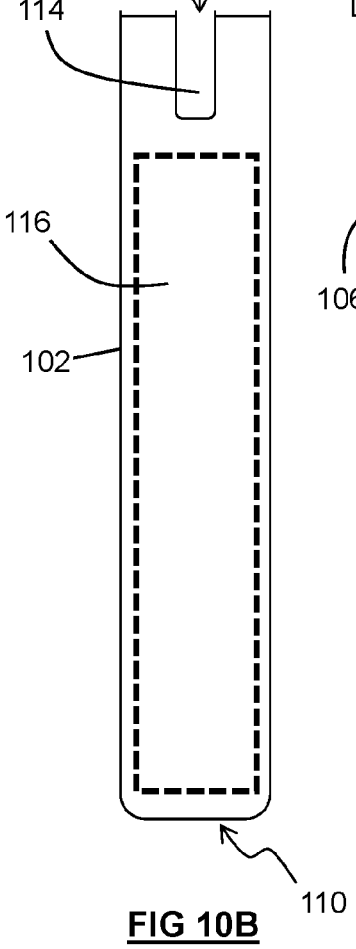
FIG. 10B is a front schematic view of a device of the system.
Figure 10C:
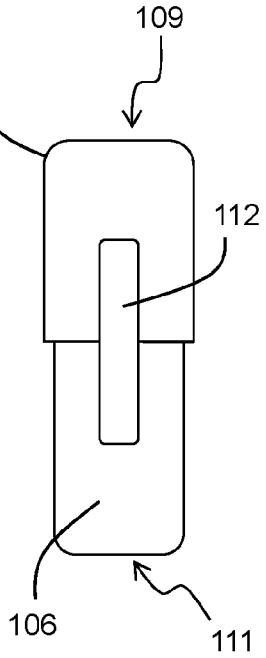
FIG. 10C is a front schematic view of a consumable of the system.

The system shown in FIGS. 10A-10C is similar to that shown in FIGS. 1A-1C and like references numerals are used for like features.

The device 102 also includes a processor/controller (not shown in FIGS. 10A-10C), and an illumination region 116, indicated by the dashed line. Below the illumination region, within the main body of the device 102 is at least one source of light (and in some examples, a plurality of sources of light) located behind a single translucent cover. The source (s) of light may be, in this example, one or more light emitting diodes. The source(s) of light may be configured to illuminate when the smoking substitute system 100 is activated. Whilst not shown, the consumable 104 may identify itself to the device 102, via an electrical interface, RFID chip, or barcode. Each source of light may be, for example, a group of LEDs operable in a combination of colors. The illumination region may be formed of a diffusing material, for example polycarbonate, such that light emitted from the LEDs is diffused as it is transmitted through the illumination region. Additionally, or alternatively, the illumination region may have a thickness which is thinner than the remaining main body of the device. Further additionally, or alternatively, a liquid crystal display (LCD) may be provided in the illumination region and may be behind the diffusion material (or alternatively, may be present as an outermost surface of the main body). In some examples, the device 102 has a mandorla-shaped cross-section, also referred to as an eye-shaped cross-section. The cross-section may have the shape resulting from the partial overlap of two circles having the substantially the same radii. In these examples, the illumination region 116 is present on the larger surface of the main body, and components supporting the illumination region (wires etc. for the LEDs) may be positioned within the thinner void region of the interior surface (i.e., towards the lateral sides thereof).

Figure 11A:
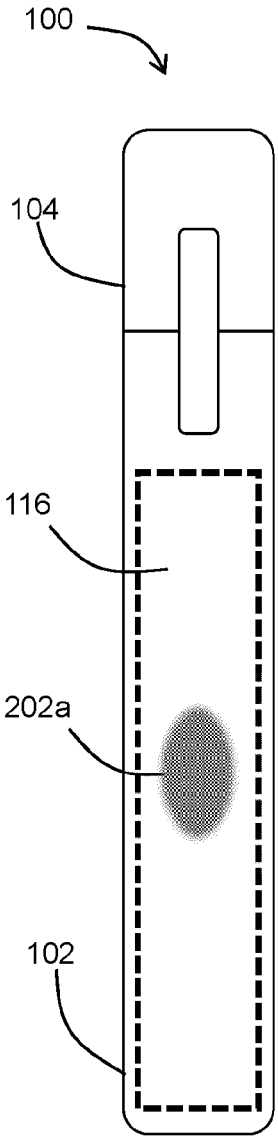
FIG. 11A is a front schematic view of the smoking substitute device in a first illumination state.

FIG. 11A shows the device 102 in a first illuminate state. Here, the processor has identified that the device is undergoing a charging operation (e.g., the power source is receiving and storing power). The processor causes a varying area of the illumination region 116 to be illuminated. In FIG. 11A a small area 202*a* of the illumination region is illuminated. Next, so as to convey the idea of the power source being filled with power, a larger area 202*b* of the illumination region is illuminated. Finally, when the power source is filled with power, the largest area 202*c* of the illumination region is illuminated.

The processor is configured to achieve this variation in the illuminated area by control of one or both of: (i) an intensity of the LEDs; and (ii) a number of LEDs illuminated.

Figure 11B:
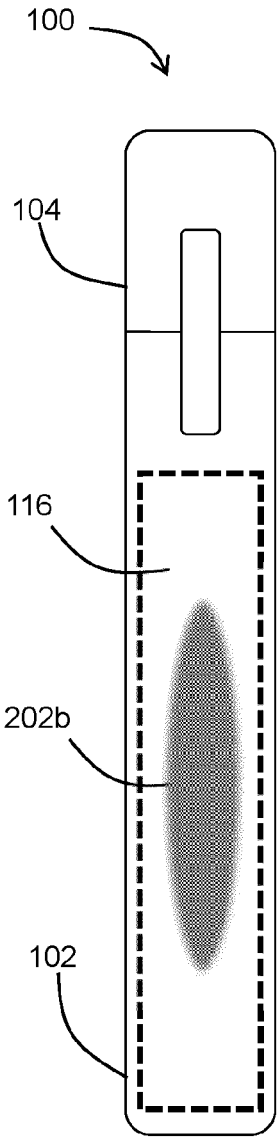
FIG. 11B is a front schematic view of the smoking substitute device in a second illumination state.
Figure 11C:
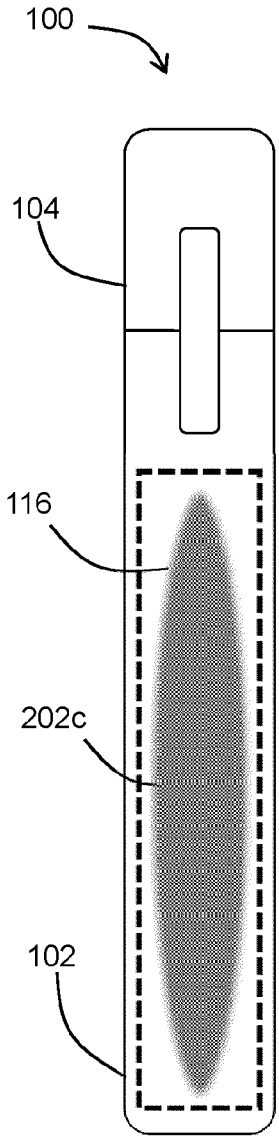
FIG. 11C is a front schematic view of the smoking substitute device in a third illumination state.

The sequence shown in FIG. 11A-11C is an example of a possible sequence using the illumination region. For example, in alternative sequence performed using the same device, a bar decreases in height in a manner commensurate with the depletion of the battery or consumable 104. In a further alternative sequence, the connection of a valid consumable 104 to the main body 102 may cause the illumination region to undergo a sequence of illumination states to indicate that the connection has been made successfully. Further alternatively, the processor may be configured to detect an inhalation event (e.g., through a pressure sensor) and to cause the illumination region to mimic a breath sequence by pulsating the illumination region. For example, the area of the illumination region illuminated may increase in proportion with an inhalation time, and decrease in proportion to an exhalation time.

Figure 12A:
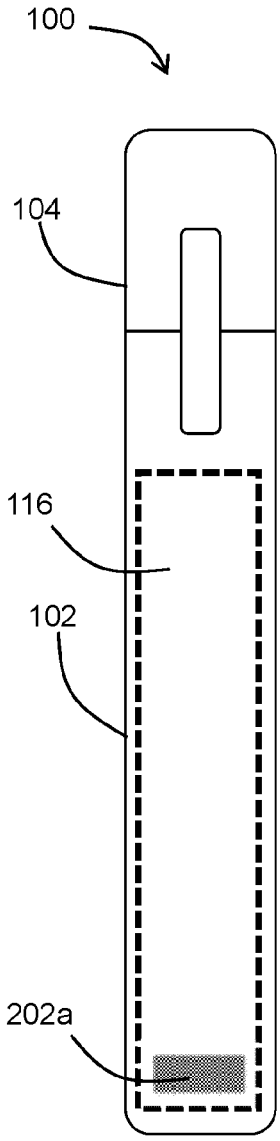
FIG. 12A is a front schematic view of the smoking substitute device in a variant first illumination state.
Figure 12B:
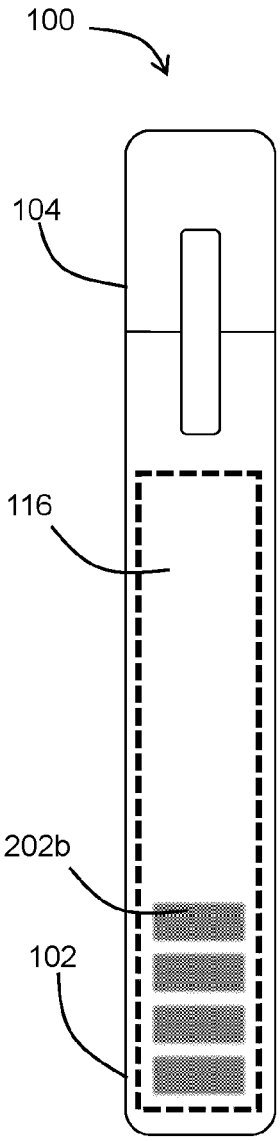
FIG. 12B is a front schematic view of the smoking substitute device in a variant second illumination state.
Figure 12C:
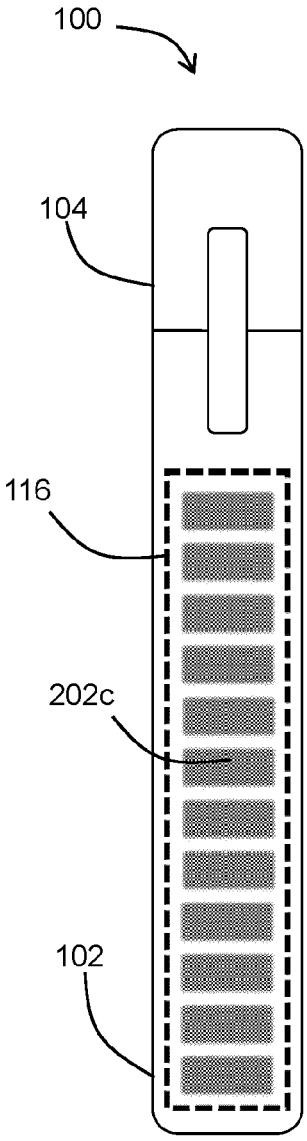
FIG. 12C is a front schematic view of the smoking substitute device in a variant third illumination state.

In the sequences shown above, the illuminated area 202*a-c* is contiguous. However, the processor may be configured to increase and/or decrease the illuminated area by illuminating discrete portions of the illumination region, referred to as sub-illumination regions. An example of the same sequence of FIGS. 11A-11C, but with discrete illumination areas, is shown in FIGS. 12A-2C. In the example shown in FIGS. 12A-12C, each sub-illumination region is separated from the adjacent sub-illumination regions by an optically opaque divider.

Figure 13A:
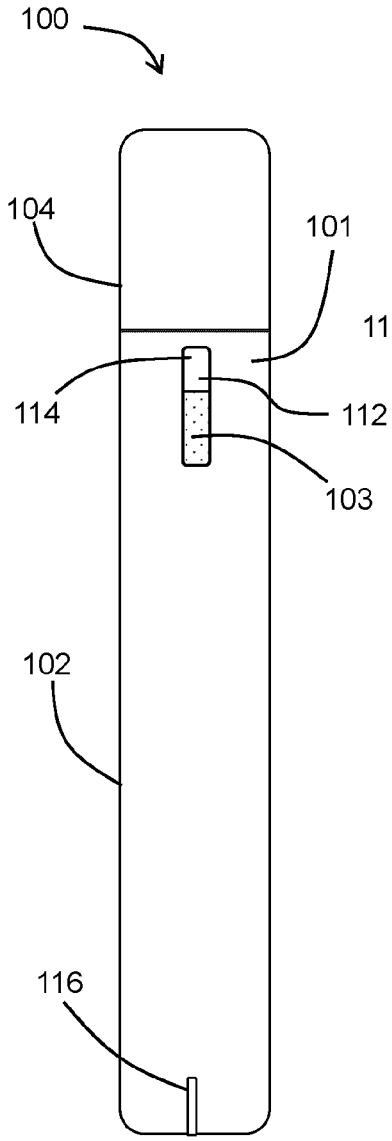
FIG. 13A is a front schematic view of a smoking substitute system.
Figure 13B:
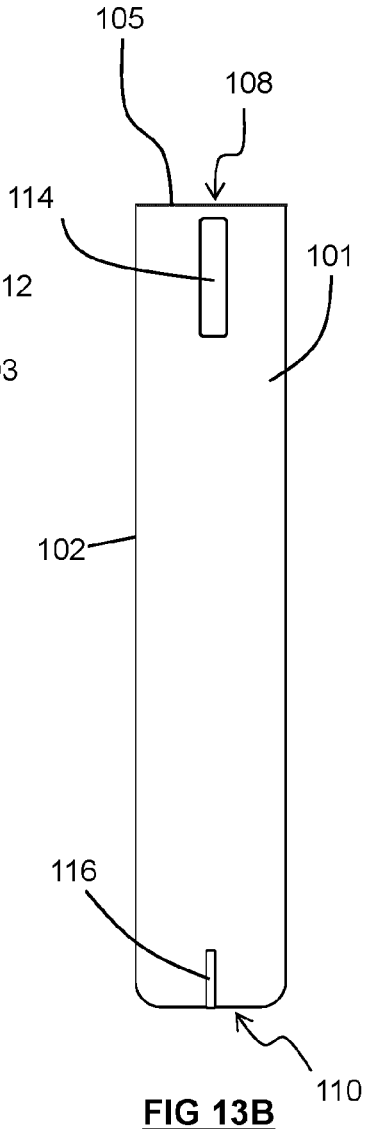
FIG. 13B is a front schematic view of a device of the system.
Figure 13C:
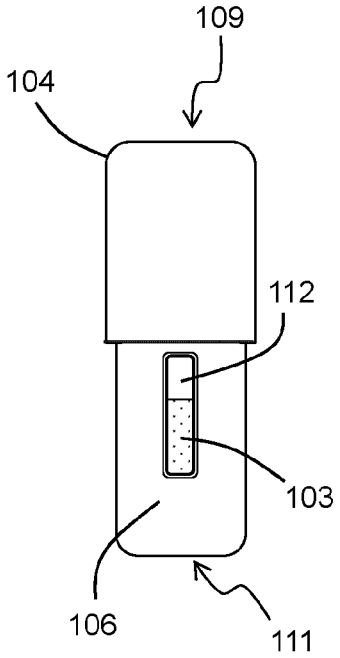
FIG. 13C is a front schematic view of a consumable of the system.

The system shown in FIGS. 13A-13C is similar to that shown in FIGS. 1A-1C and like references numerals are used for like features.

A wall of the tank 106 includes a translucent portion in the form of a window 112, which allows the amount of e-liquid 103 in the tank 106 to be visually assessed. An aperture 114 is formed in a wall of the housing 101 of the device 102 so that the window 112 of the consumable 104 can be seen whilst the rest of the tank 106 is obscured from view when the consumable 104 is inserted into the cavity at the upper end 108 of the device 102.

The aperture 114 is obround, so as to be elongate and so as to define an elongate axis. The aperture has a width (transverse to the elongate axis) of about 4 mm, and a length (parallel to the elongate axis) of about 15 mm. The aperture 114 is oriented such that its elongate axis is generally parallel with a longitudinal axis of the device (in the figures, this is in the vertical direction). The aperture 114 is proximate to (but spaced from) an edge 105 of the wall of the housing 101 (in which the aperture is formed).

Figure 13D:
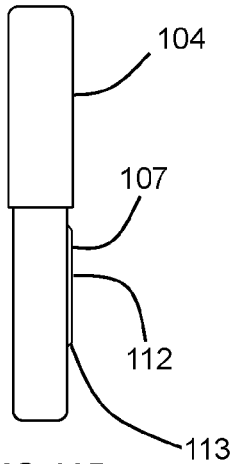
FIG. 13D is a side schematic view of the consumable of the system.

As mentioned above, when the consumable 104 is received in the cavity of the device 102, the window 112 aligns with the aperture 114 in the housing 101, such that the e-liquid 103 in the tank 106 is visible. As is particularly apparent from FIG. 13D, the window 112 defines a raised (or protruding portion) of the tank 106. In this way, and as will now be described, the window 112 acts as a retaining portion of the consumable 104 for retaining the consumable 104 in the cavity of the device 102.

The window 112 is arranged on the tank 106 such that, when the consumable 104 is inserted into the cavity of the device 102, the window 112 aligns with the aperture 114 formed in the housing 101 and is thus received in the aperture 114. The window 112 has the same obround shape as the aperture 114 formed in the housing 101 such that it fills the aperture 114 in this engaged position and restricts movement of the consumable 104 out of the cavity (i.e., by contact with the edge of the aperture 114).

Whilst not immediately apparent from the figures, the height of the window 112 (i.e., from the wall of the tank 106 from which it protrudes) is substantially the same as the depth of the aperture 114 in the housing 101. Thus, when the window 112 is received in the aperture 114, the distal surface 107 of the window 112 is generally flush with an outer surface of the housing 101.

To facilitate snap-engagement between the consumable 104 and the device 102, the window 112 and the housing 101 are configured to be deformable. Thus, as the consumable 104 is inserted into the device 102, the window 112 and the housing 101 flex (i.e., deflect) so as to allow the consumable 104 to move into the cavity (i.e., which would otherwise be prevented by the protrusion of window 112 from the consumable 104).

In order to provide this deflection in a gradual manner, the window 112 comprises a ramp surface, which in this case is a sloped sidewall 113 extending about the distal end surface 107 (i.e., connecting the distal end surface 107 to the outer surface of the consumable 104). When the consumable 104 is moved towards the cavity of the device 102, the ramp surface 113 engages the upper edge 105 of the housing 101. Due to the sloped nature of the ramp surface 113, as the consumable 104 is moved into the cavity, the contact between the ramp surface 113 and the edge 105 causes gradual deflection of the edge 105 and/or the window 112 to allow the consumable 102 to be inserted into the cavity. When the window 112 reaches the aperture 114 it snaps into engagement with the aperture 114. The ramp surface may similarly facilitate removal of the consumable 102 from the cavity (i.e., by contact with an edge of the aperture 114).

Figure 14A:
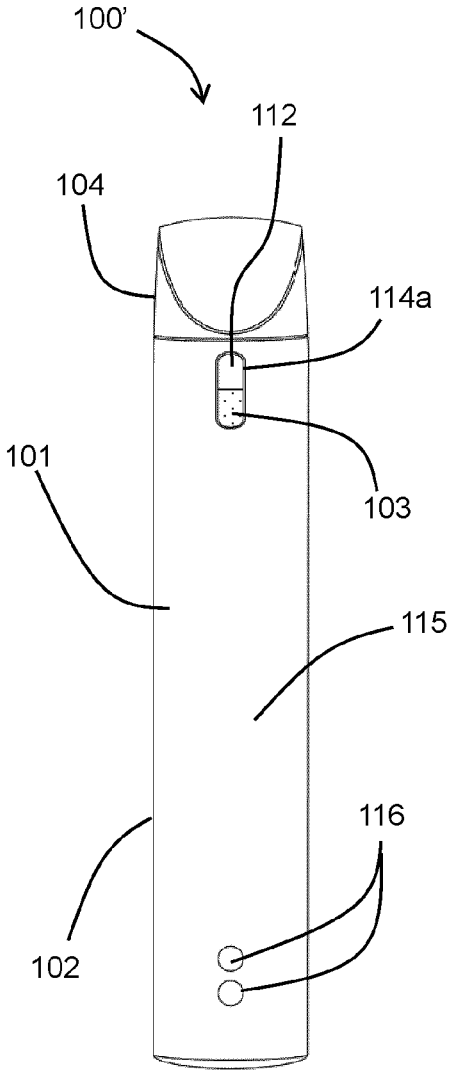
FIG. 14A is a front view of a further smoking substitute system.
Figure 14B:
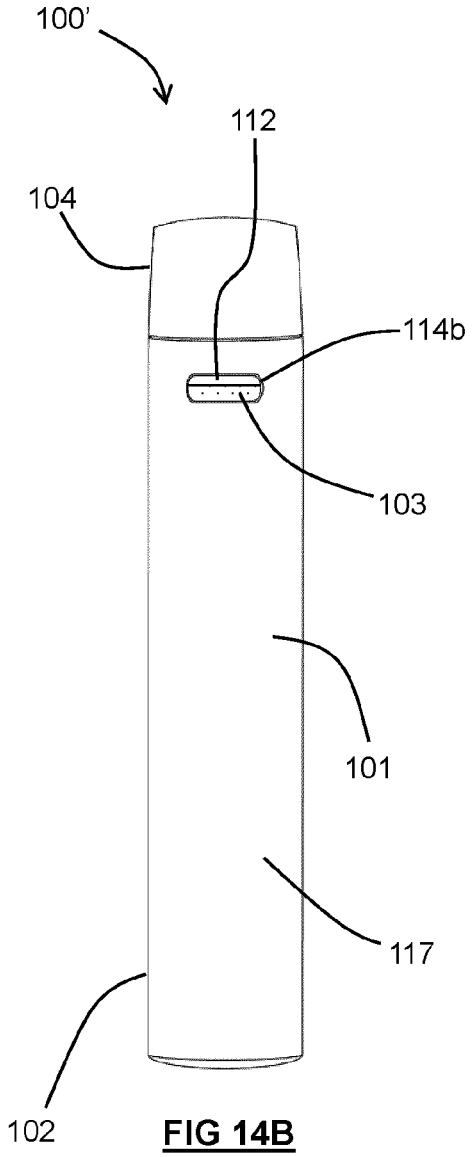
FIG. 14B is a rear view of the further smoking substitute system.

FIGS. 14A and 14B illustrate a variation of the embodiment shown in FIGS. 13A to 13D and therefore corresponding reference numerals have been used to identify similar features. FIG. 14A shows a front view of a smoking substitute system 100' and FIG. 14B shows a rear view of the smoking substitute system 100'.

As is particularly apparent from FIG. 14B, the smoking substitute system 100' differs from that described above in that the housing 101 comprises first 114*a* and second 114*b* apertures formed therein. The first aperture 114*a* is formed in a front wall 115 of the housing 101 and the second aperture 114*b* is formed in a rear wall 117 of the housing.

Both of the apertures 114*a*, 114*b* have an elongate obround shape, but they are oriented such that an elongate axis of the second aperture 114*b* is orthogonal to an elongate axis of the first aperture 114*a*. In particular, as shown on the page, the elongate axis of the first aperture 114*a* is oriented vertically, and the elongate axis of the second aperture 114*b* is oriented horizontally. As may be appreciated, this may allow the assessment of the level of e-liquid 103 in the consumable 104 for two orientations of the device. That is, the first aperture 114*a* may be configured for viewing the level of e-liquid 103 when the system 100' is oriented vertically (e.g., when handheld), and the second aperture may be configured for viewing the level of e-liquid 103 when the system 100' is oriented horizontally.

Whilst not apparent from the figures, in this embodiment, the tank of the consumable 104 is fully translucent (i.e., so as not to have isolated translucent portions).

One further (minor) difference between this system 100' and the system described above with respect to FIG. 1A to 1D is that instead of a single LED, the present system 100' includes two separate (longitudinally spaced) circular LEDs.

Figure 15A:
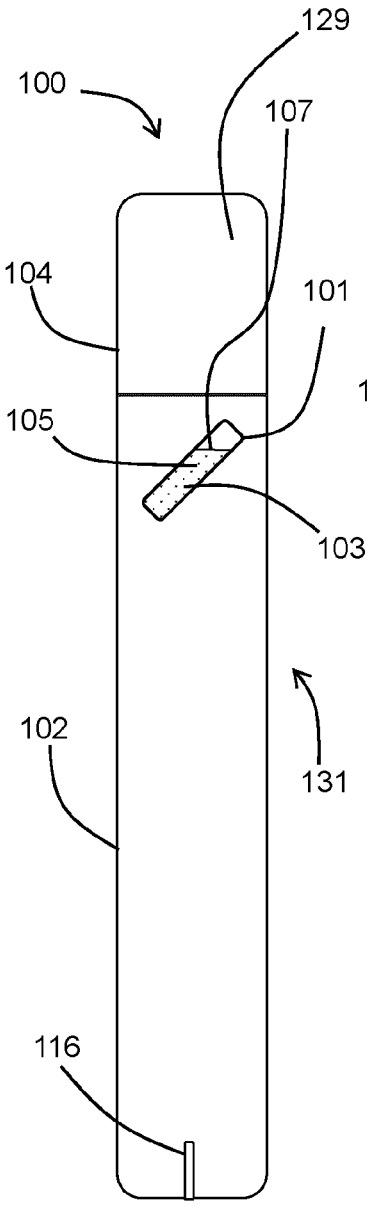
FIG. 15A is a front schematic view of a smoking substitute system, in a vertical orientation.
Figure 15B:
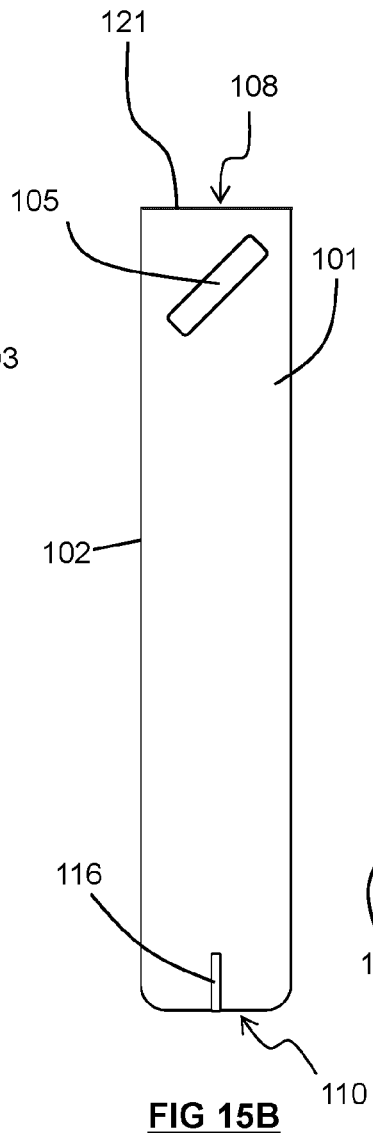
FIG. 15B is a front schematic view of a device of the system.
Figure 15C:
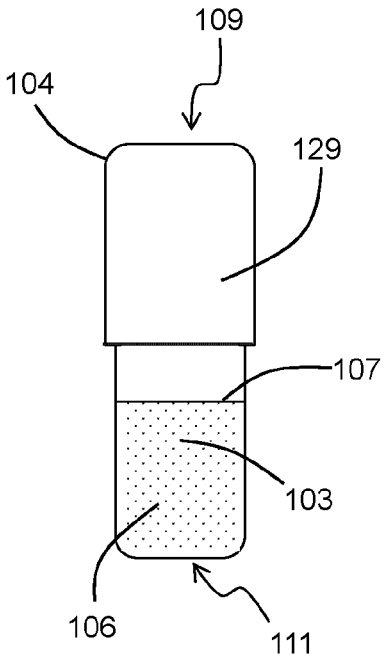
FIG. 15C is a front schematic view of a consumable of the system.

The system shown in FIGS. 15A-15C is similar to that shown in FIGS. 1A-1C and like references numerals are used for like features.

Figure 15D:
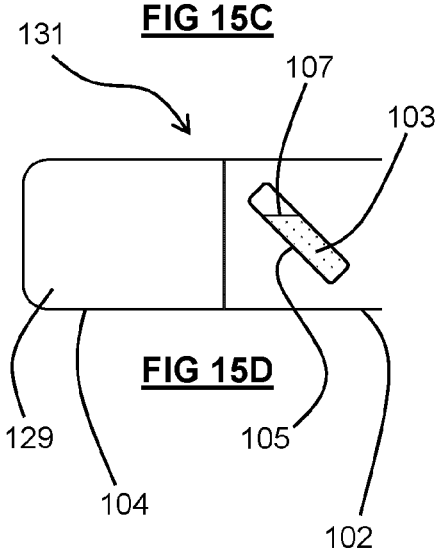
FIG. 15D is a front schematic view of the system in a horizontal orientation.

FIG. 15A shows the smoking substitute system 100 with the device 102 physically coupled to the consumable 104 and in a vertical orientation, FIG. 15B shows the device 102 of the smoking substitute system 100 without the consumable 104, and FIG. 15C shows the consumable 104 of the smoking substitute system 100 without the device 102. FIG. 15D shows the device and consumable coupled, but in a horizontal orientation.

The device 102 comprises a device housing 101 and the consumable 104 comprises a consumable housing 129, which together define a system housing 131. The device housing 101 defines a cavity (not shown in the present figures) for receipt of a tank 106 of the consumable 104, which forms part of the consumable housing 129. The device 102 and the consumable 104 are configured to be physically coupled together by pushing the consumable 104 into the cavity at an upper end 108 of the housing 101, such that there is an interference fit between the device 102 and the consumable 104. In other examples, the device 102 and the consumable may be coupled by screwing one onto the other, or through a bayonet fitting.

The consumable 104 includes a mouthpiece (not shown in FIG. 15A to 15D) at an upper end 109 of the consumable 104, and one or more air inlets (not shown) in fluid communication with the mouthpiece such that air can be drawn into and through the consumable 104 when a user inhales through the mouthpiece. The tank 106 contains an aerosol precursor in the form of an e-liquid 103 and is located at the lower end 111 of the consumable 104.

As is particularly apparent from FIG. 15A, the device housing 101 includes a single viewing region in the form of a window 105 (i.e., defined by an aperture formed in the device housing 101). This window 105 allows the amount of e-liquid 103 in the tank 106 to be visually assessed. As is evident from FIG. 1C, the walls of the tank 106 are translucent to permit the e-liquid 103 to be viewed through the window 105. It is noted, however, that the only portion of the tank 106 visible is that which is aligned with the window 105, because the remaining portions of the tank 106 are obscured by the wall of the housing 101 of the device 102 defining the cavity. As is discussed above, this may limit the amount of light received by the e-liquid 103.

The window 105 formed in the device housing 101 is elongate (obround) so as to define an elongate axis, and is oriented such that the elongate axis is oblique (i.e., neither perpendicular nor parallel) with respect to a longitudinal axis of the device housing 101 (and of the system housing 131). In other words, the window 105 is slanted with respect to the longitudinal axis of the device housing 101. This means that the window 105 extends both longitudinally and transversely.

This orientation of the window 105 allows the level of e-liquid 103 to be viewed for both a vertical orientation (FIG. 15A) of the longitudinal axis of the device housing 101, and a horizontal orientation (FIG. 15D) of the device housing 101. In particular, the longitudinal extension of the window 105 allows assessment of the level in the vertical orientation (FIG. 15A) and the transverse extension of the window 105 allows assessment of the level in the horizontal orientation (FIG. 15D). Thus, a user may, for example, view the e-liquid 103 level when handheld (e.g., vertical) and when resting on a surface (e.g., horizontal).

In both orientations, the meniscus 107 of the e-liquid 103 extends transversely with respect to the elongate axis of the window 105. This ensures that a range of levels can be measured (i.e., along the elongate axis) as the e-liquid 103 is depleted, whilst minimizing the amount of light entering the e-liquid 103 (i.e., by only providing a strip/elongate shape through which the e-liquid 103 can be viewed).

Figure 16A:
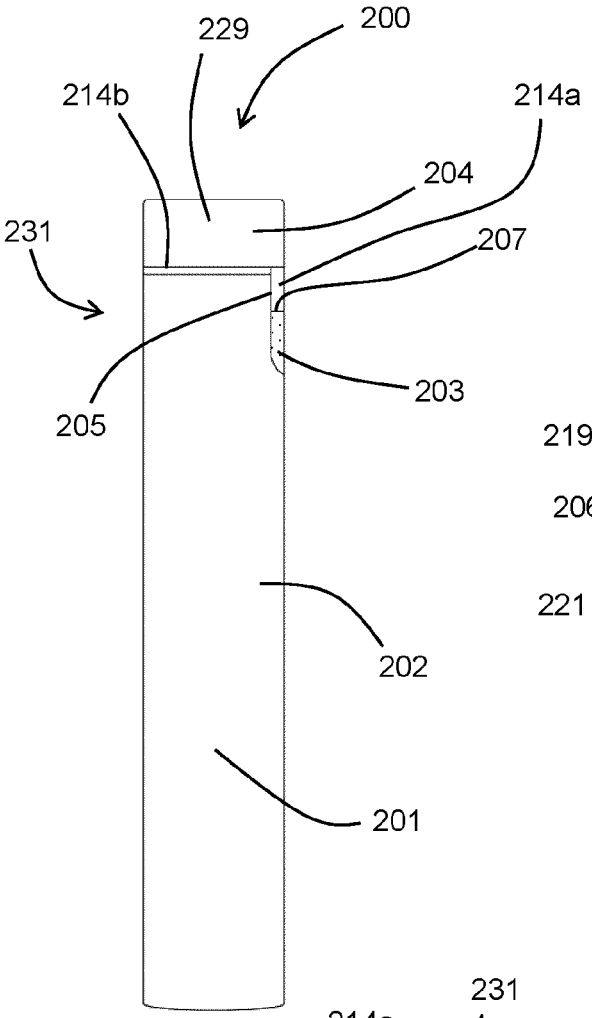
FIG. 16A is a front schematic view of a smoking substitute system, in a vertical orientation.
Figure 16B:
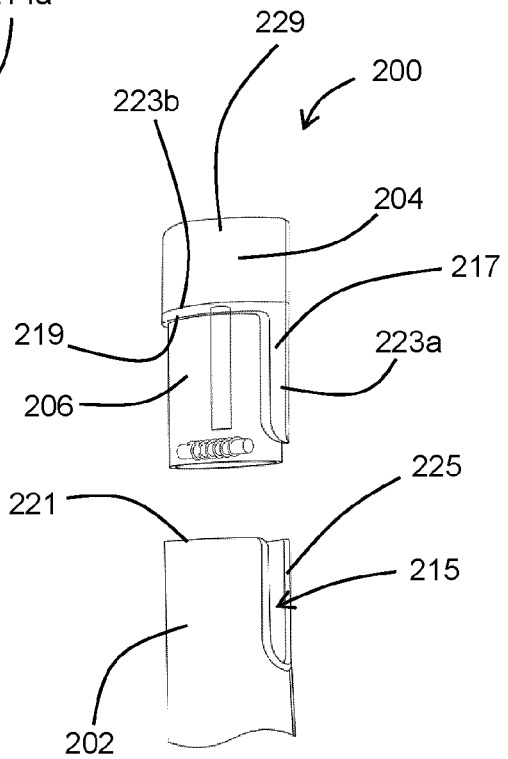
FIG. 16B is an exploded view of the smoking substitute system of the FIG. 16A embodiment.
Figure 16C:
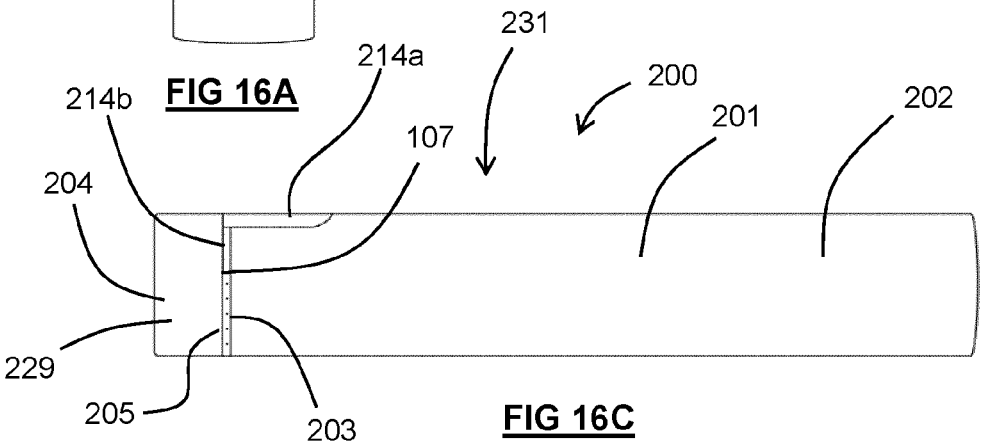
FIG. 16C is a front schematic view of the smoking substitute system of the FIG. 16A embodiment in a horizontal orientation.

The smoking substitute system 200 shown in FIGS. 16A to 16C shares many of the same features of the system described above, and for that reason, corresponding reference numerals have been used (albeit, with the first digit replaced to represent the different embodiment).

This embodiment differs from that previously described in that the system 200 comprises two elongate viewing regions (rather than a single region) in the form of first 214*a* and second 214*b* elongate window portions of a window 205. The second window portion 214*b* is oriented such that its elongate axis extends transversely with respect to a longitudinal axis of the device housing 201. In particular, the second window portion 214*b* forms a loop that extends about the system housing 231 (i.e., about the longitudinal axis of the hosing 201). The first window portion 214*a* is oriented such that its elongate axis extends longitudinally (i.e., parallel to the longitudinal axis of the housing 201). The first window portion 214*a* joins with the second window portion 214*b* at its upper end, so as to form a generally L-shaped window.

In this way, when the system housing 231 is oriented vertically (FIG. 16A), the meniscus 207 of the aerosol precursor 203 in the tank 206 (i.e., indicating the level of precursor) may be viewed through the first window portion 214*a*, and when the system housing 231 is oriented horizontally (FIG. 16C) the aerosol precursor level may be viewed through the second window portion 214*b*. In both orientations, the meniscus 207 extends transversely with respect to the elongate axis of the corresponding window portion 214*a*, 214*b*.

The window 205 (and window portions 214*a*, 214*b*) are partly defined by the consumable 204 and partly defined by the device 202, when the consumable 204 is received in a cavity 215 defined by the device housing 201. As is apparent from FIG. 16B in particular, the walls of the tank 206 of the consumable 204 are translucent, such that the e-liquid 203 can be viewed through the walls of the tank 206. The tank 206 comprises a raised region 217 in the shape of the window 205. Thus, the raised region 217 comprises a longitudinal portion 223*a* and a transverse portion 223*b* (which respectively define the first 214*a* and second 214*b* portions of the window 205 when formed).

The raised region 217 defines a lip 219 that abuts (i.e., seats against) an upper edge 221 of the device housing 201 when the consumable 204 is engaged in the cavity 215. The shape of the upper edge 221 of the device housing 201 is complementary to the lip 219 (which defines a lower edge of the raised region 217 of the tank 206), such that the lip 219 and upper edge 221 sit flush against one another. In particular, the upper end of the device housing 201 comprises a longitudinally extending slot 225 that accommodates the longitudinal portion 223*a* of the raised region 217 of the tank 206 when the consumable 204 and device 202 are engaged.

The longitudinal slot 225, in combination with the longitudinal portion 223*a* of the raised region 217, helps to guide the consumable 204 into the cavity 215. This is facilitated by the shape of the longitudinal portion 223*a*, which has a rounded/tapered distal end.

When the consumable 204 is received in the cavity 215, the non-raised region of the tank 206 enters the cavity, whilst the raised region 217 is retained above the cavity 215 by the contact of the lip 219 with the upper edge 221 of the housing 201. In this way, only the raised region 217 of the tank 217 is visible (view of the remainder of the tank 206 being obstructed by the device housing 201). Thus, the window 205 is defined by the combination of the consumable 204 and the device 202.

Figure 17A:
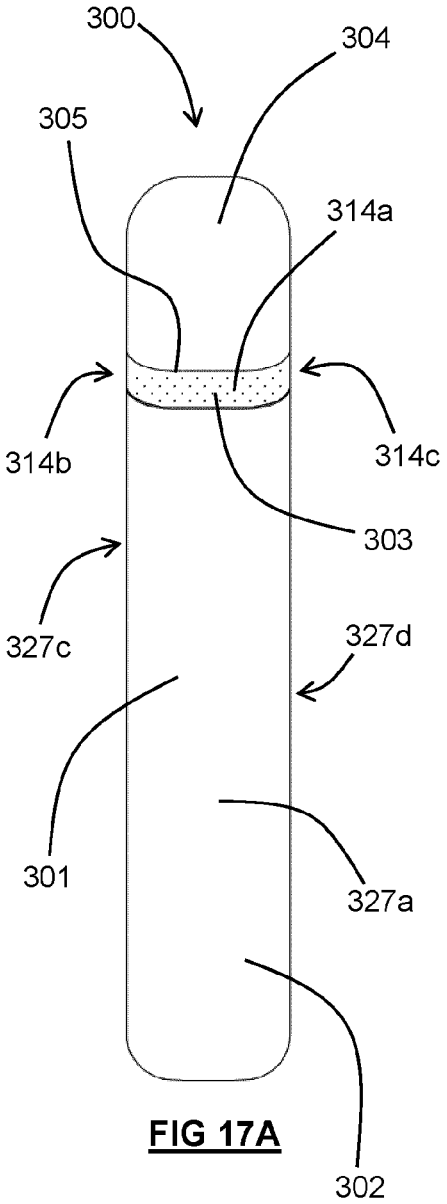
FIG. 17A is a front schematic view of a smoking substitute system.
Figure 17B:
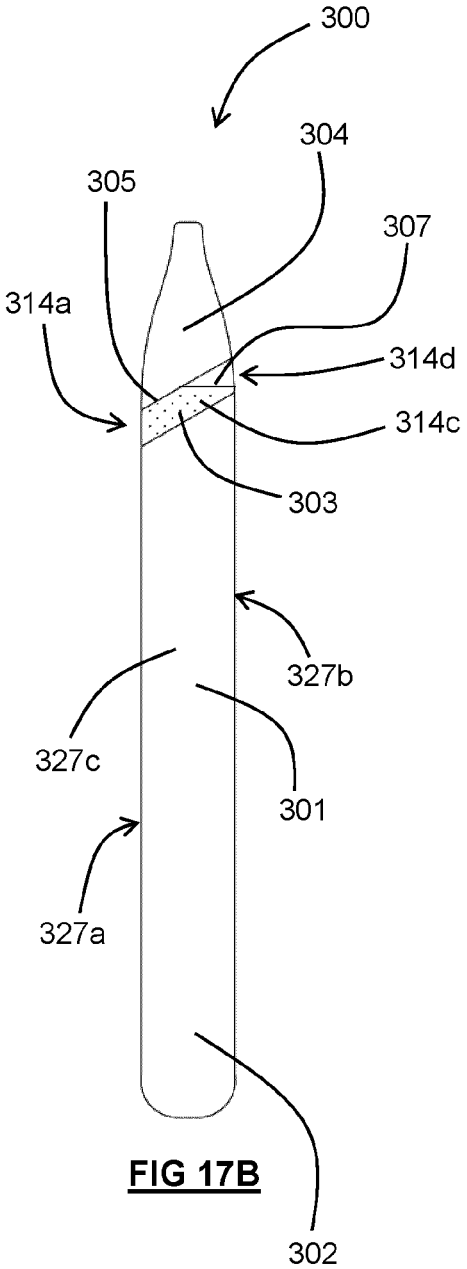
FIG. 17B is a side schematic view of the smoking substitute system of the FIG. 17A embodiment.

FIGS. 17A and 17B illustrate a further smoking substitute system 300. Again, due to similarities with the previously described systems 100, 200, corresponding reference numerals have been used. Like the previously described embodiment, this system 300 comprises a plurality of viewing regions in the form of front 314*a*, rear 314*b*, and side 314*c*, 314*d* window portions that are joined to form a window 305.

The system housing 331 (defined by a combination of the device housing 301 and the consumable housing 329) comprises opposing front 327*a* and rear 327*b* walls that are joined by opposing side walls 327*c*, 327*d* extending therebetween. The distance between the front 327*a* and rear 327*b* walls define a depth of the housing 331 and the distance between the side walls 327*b*, 327*c* define a width of the system housing 331, which is greater than the depth.

The front window portion 314*a* is formed in the front wall 327*a* of the system housing 331, the rear window portion 314*b* is formed in the rear wall 327*b* and each of the side window portions 314*c*, 314*d* is formed in a respective side wall 327*c*, 327*d*. In this way, the window portions 314*a*, 314*b*, 314*c*, 314*d* form a loop that extends about the longitudinal axis of the system housing 331.

Each of the front 314*a* and rear 314*b* window portions extends transversely with respect the longitudinal axis of the system housing 331. The rear window portions 314*b*, however, is located closer to the consumable 304 end of the system housing 331 than the front window portion 314*a*. Each of the side window portions 314*c*, 314*d* extends obliquely with respect to the longitudinal axis of the system housing 331. In particular, each side window portion 314*c*, 314*d* is sloped towards the consumable 304 end of the housing 331 in a direction from the front window portion 314*a* to the rear window portion 314*b*.

Like the previously discussed embodiments, this arrangement allows assessment of the level of aerosol precursor 303 in the tank 306 in both a vertical orientation and a horizontal orientation. In the vertical orientation (as depicted in the figures) the precursor level can be viewed through both of the side window portions 314*c*, 314*d*. As is apparent from FIG. 5B in particular, in this vertical orientation, the meniscus 307 of the precursor 303 extends transversely with respect to the elongate axes of the side window portions 314*c*, 314*d*.

Whilst not shown, it should be appreciated that, in the horizontal orientation, the precursor level can be viewed through either the side window portions 314*c*, 314*d* (due to their oblique orientation) or through the front 314*a* or rear 314*b* window portions. If the system 300 is positioned with the front wall 327 directed upwards (or downwards) the precursor level can be viewed through the side window portions 314*c*, 314*d*. If the system 300 positioned such that one of the side walls 327*c*, 327*d* is directed upwards then the precursor level can be viewed through the front 314*a* or rear 314*b* window portion.

Whilst not immediately apparent in the figures, the window 305 is formed only when the consumable 304 is engaged with the device 302. The tank 306 comprises a raised region having the same shape as the window 305 (when formed) and that defines a lip at a lower edge thereof. The lip engages with an upper edge of the device housing 301 when the tank 306 is received in the cavity of the device housing 301. Thus, the non-raised regions of the tank 306 are received in the cavity, whilst the raised region remains supported above the cavity (so as to be visible and so as to define the window 305).

While exemplary embodiments have been described above, many equivalent modifications and variations will be apparent to those skilled in the art when given this disclosure. Accordingly, the exemplary embodiments set forth above are considered to be illustrative and not limiting.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

Preferred aspects and embodiments are further described in the following paragraphs:

1. A smoking substitute device, comprising:
   an elongate main body, the main body having a body length in a longitudinal dimension that is greater than a body width in a transverse dimension;
   wherein the main body includes an upper surface and an oppositely directed lower surface, the upper and lower surfaces meeting along a pair of oppositely directed transverse edges,
   wherein an upper surface radius of curvature of the upper surface in the transverse dimension is greater than half a main body depth, wherein the main body depth is a maximum distance between the upper surface and the lower surface;
   wherein a lower surface radius of curvature in the transverse dimension of the lower surface is greater than half the main body depth.

2. A smoking substitute device according to paragraph 1, wherein an edge radius of curvature of the transverse edges is less than 5 millimeters, preferably less than 3 millimeters and preferably less than 1 millimeter.

3 A smoking substitute device according to paragraph 1 or paragraph 2, wherein the maximum depth of the main body is between 5 and 30 millimeters, preferably between 10 and 20 millimeters.

4. The smoking substitute device according to any preceding paragraph, wherein the main body of the device is curved in the longitudinal dimension.

5. The smoking substitute device according to any preceding paragraph, wherein the upper surface radius of curvature is different from the lower surface radius of curvature.

6. The smoking substitute device according to any one paragraphs 1 to 4, wherein the upper surface radius of curvature is substantially equal to the lower surface radius of curvature.

7. The smoking substitute device according to any preceding paragraph, wherein the device includes a device charging means located on at least one of the transverse edges.

8. The smoking substitute device according to any preceding paragraph, wherein the device includes a device charging means located on the lower surface.

9. The smoking substitute device according to any preceding paragraph, wherein the device includes a user feedback means located along at least a portion of one of the transverse edges.

10. The smoking substitute device according to any preceding paragraph, wherein the main body has a substantially constant transverse cross sectional shape along the longitudinal dimension.

11. The substitute smoking device according to any preceding paragraph, wherein the main body includes an upper housing connected to a lower housing, wherein the upper housing includes the upper surface and the lower housing including the lower surface.

12. The substitute smoking device according to paragraph 11, wherein the upper housing is connected to the lower housing along the transverse edges.

13. A substitute smoking system, including a substitute smoking device according to any preceding paragraph and a consumable for engagement with the substitute smoking device.

14. A substitute smoking system according to paragraph 13, wherein the device is configured such that the consumable is for engagement with an engagement longitudinal end of the device.

15. A charging case for a substitute smoking device according to any preceding paragraph, wherein the charging case includes a cavity of corresponding transverse cross sectional shape to the main body of the device.

16. A smoking substitute system/device comprising:
   a movement detection unit for detecting a movement of the system;
   a haptic feedback generation unit for generating a haptic feedback; and
   a haptic feedback controller unit configured to control the haptic feedback generation unit to generate the haptic feedback in response to the detection of movement of the system.

17. A smoking substitute system/device according to paragraph 16, wherein the haptic feedback includes a sequence of activations of the haptic feedback generation unit.

18. A smoking substitute system/device according to paragraph 17, wherein the sequence of activations is selectable from a plurality of activation sequences, the plurality of activation sequences being stored in a memory of the haptic feedback controller.

19. A smoking substitute system/device according to any one of paragraphs 16-18, wherein the movement detection unit comprises an accelerometer.

20. A smoking substitute system/device according to any one of paragraphs 16-19, wherein the haptic feedback controller unit is configured to switch between an ON mode wherein the haptic feedback unit is enabled and an OFF mode wherein the haptic feedback unit is disabled.

21. A smoking substitute system/device according to any one of paragraphs 16-20, wherein the haptic feedback controller unit and the movement detection unit are configured to measure a movement of the system.

22. A smoking substitute system/device according to paragraph 21, wherein one or more predetermined movements of the system are stored in a memory of the haptic feedback controller unit and the movement detection unit is configured to identify a movement of the device corresponding to the one or more predetermined movements.

23. A smoking substitute system/device according to paragraph 22, wherein the system is configured to identify a first number of movements and to generate haptic feedback comprising a second number of activations of the haptic feedback generation unit.

24. A smoking substitute system/device according to any one of paragraphs 16-23, wherein the haptic feedback generation unit comprises a vibration generator, the vibration generator comprising:

an electric motor; and a weight eccentrically mounted on a shaft of the electric motor.

25. A smoking substitute system according to any one of paragraphs 16-24, wherein:

the smoking substitute system comprises an aerosol generator unit.

26. A smoking substitute system according to paragraph 25, wherein the aerosol generator unit comprises:

a reservoir for storing an aerosol precursor;

a porous wick arranged in an air passage extending through at least part of the smoking substitute system; and a heater;

wherein the porous wick is configured to wick the aerosol precursor from the reservoir to the heater, and wherein the heater is operable to heat the aerosol precursor to generate an aerosol from the wicked aerosol precursor.

27. A smoking substitute system according to paragraph 25, wherein:

the aerosol generator unit comprises an aerosol-forming substrate comprising tobacco material; and a heating element operable to heat the aerosol-forming substrate to generate an aerosol for entrainment in air flowing downstream from the aerosol generator.

28. A smoking substitute system according to any of paragraphs 25 to 27, comprising:

a smoking substitute device, and a consumable removably engageable with the smoking substitute device; wherein:

the consumable includes the aerosol generator unit, and wherein the smoking substitute device includes the movement detector, the haptic feedback generation unit and the haptic feedback controller.

29. A smoking substitute device configured for engagement with a consumable, the smoking substitute device and the consumable together forming a smoking substitute system according to paragraph 28.

30. A method of operating a smoking substitute system/device according to any one of paragraphs 16 to 28, comprising the steps of:

detecting a movement of the system/device; and generating a haptic feedback in response to the detection of the movement of the device/system.

31. A smoking substitute device, comprising:

a source of power, for providing power to a heater;

a first charging connection, for charging the source of power, located at one end of the smoking substitute device; and a second charging connection, for charging the source of power, located on one or more lateral sides of the smoking substitute device.

32. The smoking substitute device of claim 31, wherein the first charging connection is a USB connector.

33. The smoking substitute device of either claim 31 or claim 32, wherein the second charging connection comprises a first electrical contact and second electrical contact.

34. The smoking substitute device of claim 33, wherein the first electrical contact and the second electrical contact are resiliently biased in a direction away from the smoking substitute device.

35. The smoking substitute device of claim 33 or 34, wherein the first electrical contact is located on a first lateral side of the smoking substitute device and the second electrical contact is located on a second lateral side of the smoking substitute device.

36. The smoking substitute device of claim 35, wherein the second lateral side is opposite the first lateral side.

37. The smoking substitute device of any of claims 31-34, wherein the first electrical contact and the second electrical contact are on a same lateral side of the smoking substitute device.

38. The smoking substitute device of claim 37, wherein the first electrical contact and the second electrical contact are located in a row extending along a length of the smoking substitute device away from the first charging connection.

39. The smoking substitute device of claim 37, wherein the first electrical contact and the second electrical contact are located in a row extending along a width of the smoking substitute device.

40. The smoking substitute device of any one of claims 30-39, wherein the second charging connection is nearer the end of the smoking substitute device containing the first charging connection than an opposite end of the smoking substitute device.

41. The smoking substitute device of any one of claims 30-40, wherein the source of power is a battery.

42. The smoking substitute device of any one of claims 30-41, the smoking substitute device including the heater.

43. The smoking substitute device of claim 42, wherein the heater is used in a vaporizer to vaporize an aerosol precursor.

44. The smoking substitute device of any one of claims 30-43, wherein a main body of the smoking substitute device has a mandorla-shaped cross-section.

45. A charging case for charging a smoking substitute device, the charging case comprising:

a battery, for providing power to a source of power in the smoking substitute device; and a cavity, for receiving the smoking substitute device, wherein the cavity includes a charging connection on at least one lateral internal side thereof, arranged to electrically connect to a corresponding charging connection on one or more lateral sides of the smoking substitute device.

46. A substitute smoking device, including:

a processor;

a main body, including an illumination region; and a source of light contained within the main body, the illumination region being configured such that light provided by the source of light passes through the illumination region of the main body;

wherein the processor is configured to:

(i) identify an operation of the smoking substitute device; and (ii) control the source of light contained within the main body, to illuminate an area of the illumination region based on the operation of the smoking substitute device identified.

47. The smoking substitute device of paragraph 46, wherein the source of light is an array of light emitting diodes.

48. The smoking substitute device of paragraph 46 or 47, wherein an intensity of the source of light is controlled so as to vary the area of illumination.

49. The smoking substitute device of any one of paragraphs 46 to 48, wherein there are plural sources of light contained within the main body, and a number of sources of light emitting light is controlled so as to vary the area of illumination.

50. The smoking substitute device of any one of paragraphs 46 to 49, wherein the processor is configured to identify a battery status query operation of the smoking substitute device, and to illuminate an area of the illumination region proportional to a level of charge stored in the battery.

51. The smoking substitute device of any one of paragraphs 46 to 50, wherein the processor is configured to identify a consumable status query operation of the smoking substitute device, and to illuminate an area of the illumination region proportional to a level of consumable remaining 52. The smoking substitute device of any one of paragraphs 46 to 51, wherein the processor is configured to identify an inhalation operation of the smoking substitute device, and to increase an area of the illumination region which is illuminated in proportion to a length of the inhalation operation.

53. The smoking substitute device of any one of paragraphs 46 to 52 wherein the source of light includes a liquid crystal display 54. The smoking substitute device of any one of paragraphs 46 to 53, wherein the illumination region of the main body is made from a diffusing material, such that the light passing through the illumination region from the source of light is diffused.

55. The smoking substitute device of paragraph 54, wherein the illumination region is formed of polycarbonate.

56. The smoking substitute device of any one of paragraphs 46 to 55, wherein the illumination region extends along at least half of a length of the main body.

57. The smoking substitute device of any one of paragraphs 46 to 56, wherein the main body includes a shell having a first area with a first thickness and a second area with a second thickness, the first area including the illumination region and the first thickness being thinner than the second thickness.

58. The smoking substitute device of any one of paragraphs 46 to 57, wherein the illumination region includes a plurality of discrete sub-illumination regions.

59. The smoking substitute device of paragraph 58, wherein each sub-illumination region is separated from an adjacent sub-illumination region by an optically opaque divider.

60. The smoking substitute device of any one of paragraphs 46 to 59, further comprising a mouthpiece, and wherein the illumination region is located towards an end of the smoking substitute device opposite to the mouthpiece.

61. A smoking substitute device comprising a housing defining a cavity for releasable engagement of a tank therein, and an aperture formed in a wall of the housing defining the cavity for viewing the level of an aerosol precursor stored in the tank when engaged in the cavity.

62. A smoking substitute device according to paragraph 61 wherein the aperture is elongate so as to define an elongate axis.

63. A smoking substitute device according to paragraph 62 wherein the aperture is obround.

64. A smoking substitute device according to any one paragraphs 61 to 63 wherein the aperture is a first aperture and the housing comprises a second aperture formed therein, the second aperture arranged for viewing the level of the aerosol precursor stored in the tank when engaged in the cavity.

65. A smoking substitute device according to paragraph 64 wherein the housing comprises front and rear longitudinally extending walls that are spaced by opposing longitudinally extending side walls, and wherein the distance between the side wall defines a width of the housing and the distance between the front and rear walls defines a depth of the housing that is less than the width.

66. A smoking substitute device according to paragraph 65 wherein the first aperture is formed in the front wall and the second aperture is formed in the rear wall.

67. A smoking substitute device according to paragraph 65 wherein the first aperture is formed in the front or rear wall, and the second aperture is formed in one of the side walls.

68. A smoking substitute device according to any one of claims 64 to 67 wherein the second aperture is elongate so as to define an elongate axis.

69. A smoking substitute device according to paragraph 68 wherein the elongate axis of the first aperture is orthogonal to an elongate axis of the second aperture.

70. A smoking substitute device according to paragraph 69 wherein the housing is elongate so as to define a longitudinal axis, and the elongate axis of the first aperture or the second aperture is parallel to the longitudinal axis.

71. A smoking substitute device according to any one of paragraphs 61 to 70 that is configured to deform, or comprises a deformable portion, for snap engagement with the tank.

72. A smoking substitute system comprising a smoking substitute device according to any one of the preceding claims, and a smoking substitute consumable comprising a tank for engagement in the cavity of the device, the tank containing an aerosol precursor and being configured such that the aerosol precursor of the tank is visible through the aperture of the device when the tank is received in the cavity.

73. A system according to paragraph 72 wherein at least a portion of a wall of the tank is translucent.

74. A system according to paragraph 73 wherein the translucent portion is arranged so as to align with the aperture of the device housing when the tank is received in the cavity.

75. A system according to paragraph 73 or 74 wherein the consumable comprises a retaining portion configured to engage the aperture of the device for retaining the consumable in the cavity.

76. A smoking substitute system comprising a housing defining a cavity for receipt of a liquid aerosol precursor, the housing comprising one or more elongate viewing regions extending along respective elongate axes, the one or more viewing regions arranged such that for both vertical and horizontal orientations of the housing the meniscus of the aerosol precursor is visible through a viewing region of the one or more viewing regions and extends transversely with respect to the elongate axis of the viewing region.

77. A smoking substitute system according to paragraph 76 wherein the housing is elongate and extends along a longitudinal axis and the one or more viewing regions comprises an angled viewing region having a respective elongate axis that is oriented obliquely with respect to the longitudinal axis.

78. A smoking substitute system according to paragraph 77 wherein the angled viewing region extends on an angle of between 40 and 80 degrees with respect to the longitudinal axis.

79. A smoking substitute system according to any one of paragraphs 76 to 78 wherein the one or more viewing regions comprises first and second viewing regions that are oriented so as to be orthogonal to one another.

80. A smoking substitute system according to paragraph 79 wherein the first and second orthogonal viewing regions are joined.

81. A smoking substitute system according to paragraph 80 wherein the first and second viewing regions are joined at respective ends so as to form an L-shape.

82. A smoking substitute system according to paragraph 79 wherein the first and second orthogonal viewing regions are spaced from one another.

83. A smoking substitute system according to any one of paragraphs 79 to 82 wherein the housing is elongate and extends along a longitudinal axis and one of the first and second orthogonal viewing regions is oriented so as to be parallel to the longitudinal axis and the other of the first and second orthogonal viewing regions is oriented so as to be perpendicular to the longitudinal axis.

84. A smoking substitute system according to any one paragraphs 76 to 83, wherein the housing comprises opposing longitudinally extending front and rear walls spaced by opposing side walls, a first viewing region of the one or more viewing regions being formed in the front and/or rear wall and a second viewing region of the one or more viewing regions being formed in one of the side walls.

85. A smoking substitute system according to any one paragraphs 76 to 84, comprising a smoking substitute device and a consumable configured for engagement with the device, the consumable comprising a tank for receipt of the liquid aerosol precursor.

86. A smoking substitute device according to paragraph 84 wherein a portion of the tank is receivable in a cavity of the device and, when received therein, a portion of the tank remains outside of the cavity, the portion of the tank remaining outside of the cavity defining the one or more viewing regions.

87. A smoking substitute device according to paragraph 86, wherein the tank comprises a raised region that defines the one or more viewing regions when the portion of the tank is received in the cavity of the device.

88. A smoking substitute device according to paragraph 87 wherein the raised region defines a lip for engagement with an edge of the device defining an opening to the cavity of the device.

89. A smoking substitute system according to any one of paragraphs 85 to 88 wherein the consumable comprises heater and the device includes a power source for supplying power to the heater when the consumable is engaged with the device.

What is claimed is:

1. A smoking substitute device, comprising:

an elongate main body, the elongate main body having a body length in a longitudinal dimension that is greater than a body width in a transverse dimension;

wherein the elongate main body includes a curved portion having a curved longitudinal axis extending along the longitudinal dimension, wherein the elongate main body is rigid such that the curved longitudinal axis is a fixed axis; and wherein the elongate main body includes an upper housing surface and an opposing lower housing surface, the lower housing surface including a concave portion that extends substantially the total longitudinal length of the elongate main body.

2. The smoking substitute device according to claim 1, wherein the curved portion is located between a first longitudinal end of the main body and a second, opposite, longitudinal end of the elongate main body.

3. The smoking substitute device according to claim 1 wherein a radius of curvature of the curved longitudinal axis is between 1000 millimeters and 300 millimeters.

4. The smoking substitute device according to claim 1, wherein the upper housing surface has an upper radius of curvature in the longitudinal dimension that is different from a lower radius of curvature in the longitudinal dimension of the lower housing surface.

5. The smoking substitute device according to claim 4, wherein the lower radius of curvature is larger than the upper radius of curvature.

6. The smoking substitute device according to claim 4, wherein the upper housing surface includes a user feedback means.

7. The smoking substitute device according to claim 4, wherein a total longitudinal length across the upper housing surface is greater than a total longitudinal length across the lower housing surface.

8. The smoking substitute device according to claim 4, wherein in a taper region of the elongate main body the upper housing surface tapers towards the lower housing surface, the lower housing surface tapers towards the upper housing surface, or the lower and upper housing surfaces taper towards one another.

9. The smoking substitute device according to claim 8, wherein the taper region is along a transverse edge of the elongate main body.

10. The smoking substitute device according to claim 8, wherein the taper region is at a longitudinal end of the elongate main body.

11. A smoking substitute system, including a smoking substitute device according to claim 1 and a consumable for engagement with the smoking substitute device.

12. A smoking substitute system according to claim 11, wherein the upper housing surface has an upper radius of curvature in the longitudinal dimension that is different from a lower radius of curvature in the longitudinal dimension of the lower housing surface;

wherein in a taper region of the elongate main body the upper housing surface tapers towards the lower housing surface, the lower housing surface tapers towards the upper housing surface, or the lower and upper housing surfaces taper towards one another;

wherein the taper region is at a longitudinal end of the elongate main body; and wherein the smoking substitute device is configured such that the consumable is for engagement with an engagement longitudinal end of the smoking substitute device, the engagement longitudinal end being opposite to the longitudinal end.

* * * * *